US005622359A

United States Patent [19]

Kawano et al.

[11] Patent Number: 5,622,359

[45] Date of Patent: Apr. 22, 1997

[54] SHEET FINISHING APPARATUS

[75] Inventors: Minoru Kawano, Hachioji; Hirohiko Okabe, Tokorozawa; Kimitaka Yanai, Okegawa, all of Japan

[73] Assignee: Konica Corporation, Japan

[21] Appl. No.: 568,675

[22] Filed: Dec. 7, 1995

[30] Foreign Application Priority Data

Dec. 14, 1994 [JP] Japan ..... 6-310758

[51] Int. Cl.[6] ..... B65H 39/00

[52] U.S. Cl. ..... 270/58.12; 270/58.16; 270/58.17; 270/58.27

[58] Field of Search ..... 270/58.08, 58.11, 270/58.12, 58.17, 58.27, 58.14, 58.16; 355/322, 324

[56] References Cited

U.S. PATENT DOCUMENTS 4,917,364 4/1990 Iida et al. ..... 270/58.17 X
5,021,837 6/1991 Uto et al. ..... 270/58.17 X
5,092,509 3/1992 Naito et al. ..... 270/58.16 X
5,129,640 7/1992 Kosaka et al. ..... 270/58.12 X
5,407,186 4/1995 Hayama et al. ..... 270/58.08 X

*Primary Examiner*—Hoang Nguyen
*Attorney, Agent, or Firm*—Bierman and Muserlian

[57] ABSTRACT

A sheet finishing apparatus for finishing sheets ejected from an image forming apparatus, which has a sheet conveyor, a stacker, a sheet stopper at a lower end of the stacker, a movable alignment plate on at least one side edge position of the sheets. The apparatus further includes a driver for driving the movable alignment plate, a stapler. The apparatus is provided with a controller for controlling the driver such that the movable alignment plate is moved to a first position to receive the sheets, at which the plate is located outside one edge of a width direction of the sheets by a predetermined distance, when the sheets are conveyed onto the stacker from the sheet conveyor; the plate is moved to a second position to align the width direction of a first sheet of a plurality of successive sheets, at which the plate is located closer to the one edge of the sheets than the first position, when the first sheet advances on the stacker toward the sheet stopper; and the plate is moved to a third position to push the one edge of the sheets for alignment after a second and later sheets collide with the sheet stopper.

6 Claims, 17 Drawing Sheets

210
241
P1
P2
D1
D2
D3
E1
E2
W
20mm
15mm
15mm CW
8mm
8mm CW
23mm
23mm CCW
5mm
3mm
17mm
17mm CW
17mm CCW

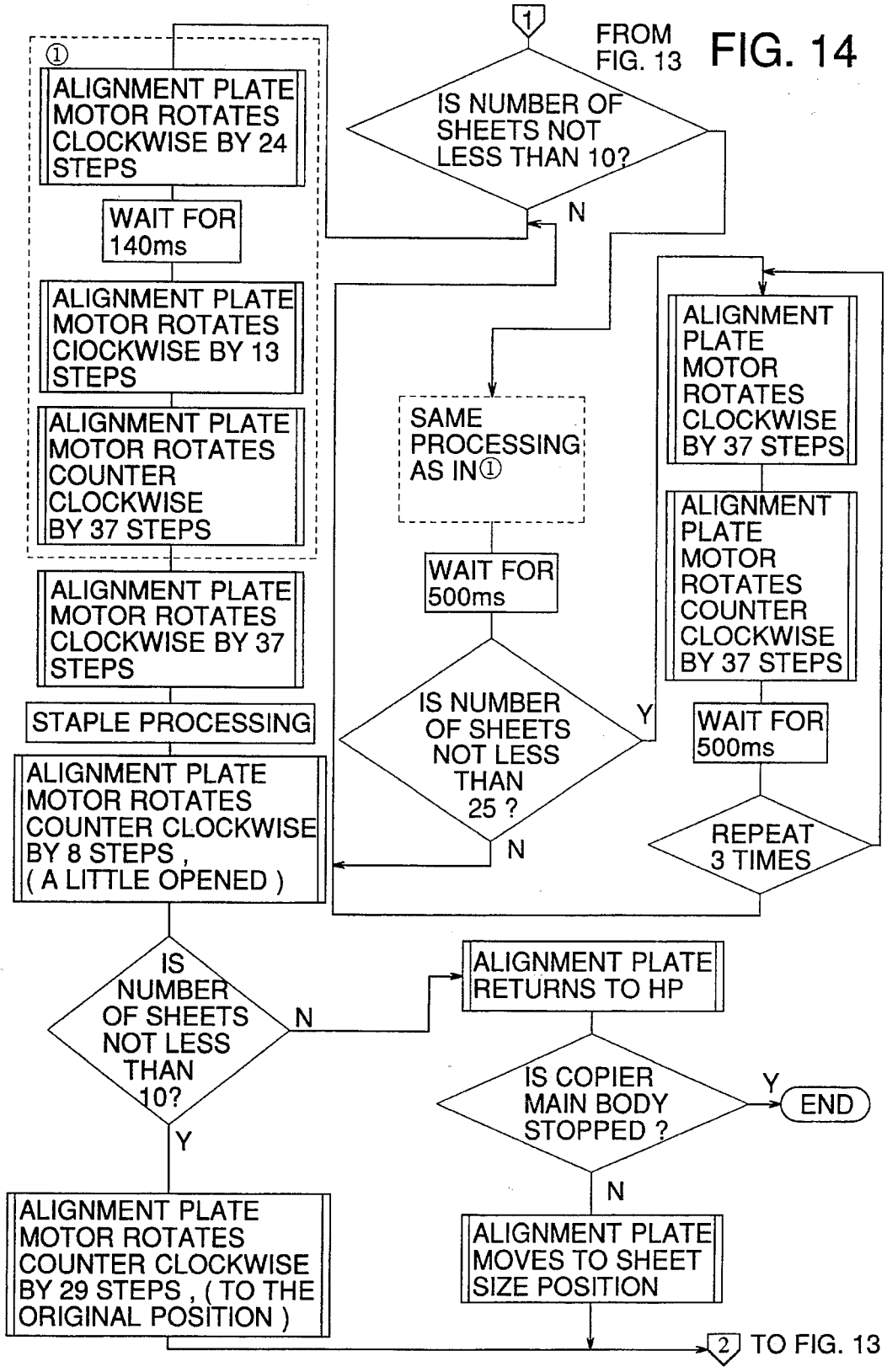
FROM FIG. 13
FIG. 14
IS NUMBER OF SHEETS NOT LESS THAN 10?
N
①
ALIGNMENT PLATE MOTOR ROTATES CLOCKWISE BY 24 STEPS
WAIT FOR 140ms
ALIGNMENT PLATE MOTOR ROTATES CIOCKWISE BY 13 STEPS
ALIGNMENT PLATE MOTOR ROTATES COUNTER CLOCKWISE BY 37 STEPS
ALIGNMENT PLATE MOTOR ROTATES CLOCKWISE BY 37 STEPS
STAPLE PROCESSING
ALIGNMENT PLATE MOTOR ROTATES COUNTER CLOCKWISE BY 8 STEPS , ( A LITTLE OPENED )
SAME PROCESSING AS IN①
WAIT FOR 500ms
IS NUMBER OF SHEETS NOT LESS THAN 25 ?
Y
N
ALIGNMENT PLATE MOTOR ROTATES CLOCKWISE BY 37 STEPS
ALIGNMENT PLATE MOTOR ROTATES COUNTER CLOCKWISE BY 37 STEPS
WAIT FOR 500ms
REPEAT 3 TIMES
IS NUMBER OF SHEETS NOT LESS THAN 10?
N
Y
ALIGNMENT PLATE RETURNS TO HP
IS COPIER MAIN BODY STOPPED ?
Y
END
N
ALIGNMENT PLATE MOVES TO SHEET SIZE POSITION
ALIGNMENT PLATE MOTOR ROTATES COUNTER CLOCKWISE BY 29 STEPS , ( TO THE ORIGINAL POSITION )
TO FIG. 13

SHEET FINISHING APPARATUS

BACKGROUND OF THE INVENTION

The present invention relates to a sheet finishing apparatus for stapling recording sheets, on which an image is recorded by an image forming apparatus, by a stapler and for delivering the stapled sheets outside the image forming apparatus. Specifically, the present invention relates to a sheet alignment means, provided in a sheet finishing apparatus, which can satisfy high speed processing.

A sheet finishing apparatus, which is called a finisher, is used as an apparatus in which a plurality of sheets, on which images have been recorded, and which are delivered outside the image forming apparatus, are collated and stapled by a stapling means for each copy volume.

In this finisher, its functions are combined with an image forming apparatus main body, and are driven corresponding to sequence operations of the copying process.

Accordingly, a finisher is required in which high speed processing can be carried out, matching the speed of an image forming apparatus in which high speed copy processing can be carried out.

Proposals for such a finisher, by which high speed processing can be carried out, are disclosed in the following publications: Japanese Patent Publication Open to Public Inspection Nos. 142359/1985, 158463/1985, 239169/1987, 288002/1987, 267667/1988, and 276691/1990, and Japanese Patent Publication No. 41991/1993.

In the sheet finishing apparatus, the following operations are carried out. A sheet, on which the image has been recorded, and which has been delivered from an image forming apparatus, is aligned in an intermediate stacker and successively placed on the stacker. After one copy set of sheets have been placed on the stacker, sheet finishing processing such as stapling are carried out. A volume of stapled sheets is sent by a transfer lever of a sheet transfer means, and conveyed by a delivering belt provided at the bottom of the intermediate stacker. The volume of sheets are sandwiched by a pair of sheet delivery rollers, which are vertically provided, and delivered on a sheet delivery tray.

As a conventional sheet finishing processing apparatus, provided with this kind of stapler, an apparatus, in which a movable member for sheet width regulation is operated, is disclosed in Japanese Patent Publication Open to Public Inspection No. 288003/1987, or the like. Further, a sheet alignment apparatus of an intermediate sheet feed apparatus in a two-sided copier is disclosed in Japanese Patent Publication No. 15391/1994.

Sheets, which are conveyed from the image forming apparatus to the sheet finishing processing apparatus, and which are sent to the stacker after the sheets have been conveyed by the conveyance rollers, are delivered dispersively in the direction of sheet width. Accordingly, movable alignment plates of an alignment means are largely withdrawn in the direction of the sheet width when sheets are conveyed into the stacker. In the sheets, the first sheet slides on the stacker surface and contacts with a stopper, and is aligned in the sheet advancing direction. The succeeding sheets slide on the first sheet and advance to the stopper position. A rotational delivery belt, located such that it slightly protrudes from the stacker surface, delivers a stapled sheet volume outside the image forming apparatus. Since the first sheet, which slides on the stacker, slides directly on the delivery belt, the first sheet does not easily slip down in the direction of the stopper, so that a time lag is caused by the first sheet. Accordingly, the time until the first sheet arrives the stop position, is longer than that in the case of other sheets. Further, sheet skewing tends to occur. Accordingly, when normal sheet-alignment is carried out during the above-described period, the movable alignment plates press the side edges of sheets, and the sheet is prevented from advancing, resulting in non-uniform sheet alignment in the sheet advance direction.

Next, before the alignment operation by the movable alignment plates, the movable alignment plates are in a waiting position in which the plates are wide opened (for example, the sheet width+20 mm). The movable alignment plates receive sheets and are moved for sheet alignment in the direction of sheet advance in this status. However, when the sheet alignment operation is carried out under the conditions described above, it is necessary that the movable alignment plates are moved quite a bit from the waiting position to the sheet side edges. Accordingly, sheets are moved excessively, so that unacceptable alignment tends to occur.

Since sheets are laterally pushed during sheet slip-down by the alignment operation of the movable alignment plates, the sheets are aligned at an angle with respect to the rotating direction of the auxiliary conveyance member or the auxiliary conveyance belt, which are arranged at the sheet alignment reference side. Accordingly, a sheet having large curl on its end is caught in the above-described member, in which case unacceptable alignment occurs.

SUMMARY OF THE INVENTION

As object of the present invention is to provide a sheet finishing apparatus having the following advantages. The sheet finishing apparatus of the present invention matches an image forming apparatus in which high speed copying for about 90 sheets per minute can be carried out. Further, the sheet finishing apparatus has advantages in which a large number of sheets are aligned, finished by stapling, etc., and an unacceptable alignment problem is solved and sheets can be delivered smoothly.

The above object can be accomplished by the first embodiment structured as follows. A sheet finishing apparatus comprises: a conveyance means for guiding and conveying sheets, delivered from an image forming apparatus; an inclined stacker for receiving and stacking the sheets thereon, sent from the conveyance means; a sheet contacting stopper in the sheet advancing direction, provided near an edge portion of the stacker; a movable alignment plate, which is located on at least one side of the sheets sent on the stacker, and reciprocated in the direction of sheet width, perpendicular to the sheet advancing direction; a driving means for driving the movable alignment plate; a stapling means for stapling a volume of sheets which are stacked and aligned on the stacker; a delivery means for holding a volume of the stapled sheets on a rotating belt, and for delivering it; and a control means for controlling a motor to move the alignment plate to the following positions; the first position which is separated outside one side edge of the sheet by a predetermined distance, and in which the sheets are received when the sheets are sent from the conveyance means to the stacker; the second position at which the movable alignment plate regulates the sheet in the direction of the sheet width when the first sheet advances on the stacker to the stopper, the second position being closer to the side edge of the sheet than to the position in which the sheets are received; and the third position at which the sheets are aligned by the movable alignment plate by pressing the side edge of the sheets after the second sheet and the succeeding sheets have come into contact with the stopper.

Further, the above object can be accomplished by the second embodiment structured as follows. A sheet finishing apparatus comprises: a conveyance means for guiding and conveying sheets, delivered from an image forming apparatus; an inclined stacker for receiving and stacking the sheets thereon, sent from the conveyance means; a sheet contacting stopper in the sheet advancing direction provided near an edge portion of the stacker; a movable alignment plate, which is located on at least one side of the sheets sent on the stacker, and reciprocated in the direction of sheet width, perpendicular to the sheet advancing direction; a driving means for driving the movable alignment plate; a stapling means for stapling a volume of sheets which are stacked and aligned on the stacker; a delivery means for holding the volume of the stapled sheets on a rotating belt, and for delivering it; and a control means for controlling a motor which moves the alignment plate to the following positions; an initial position which is separated outside one side edge of the sheet by a predetermined distance, and in which the sheets are received when the sheets are sent from the conveyance means to the stacker; an intermediate position at which the movable alignment plate regulates the sheet in the sheet advancing direction after the trailing edge of the sheet has passed near the conveyance means, the intermediate position being slightly separated from the side edge of the sheet; and an alignment position at which the sheets are aligned by the movable alignment plate by pressing the side edge of the sheets after the sheets have come into contact with the stopper.

BRIEF DESCRIPTION OF THE DRAWINGS

FIG. 8(*b*) is a sectional view, taken on line A—A in FIG. 8(*a*).

FIG. 8(*c*) is a sectional view, taken on line B—B in FIG. 8(*a*).

FIG. 11 (*a*-1) through FIG. 11(*b*-4) are plan views for explaining stop positions of the movable alignment plates for sheet alignment.

FIG. 14 is a flow chart showing another operation process of the alignment means.

FIG. 17 (*a*-1) through FIG. 17 (*b*-3) are plan views for explaining stop position of the movable alignment plate at the time of completion of copying operation for one copy volume.

DETAILED DESCRIPTION OF THE PREFERRED EMBODIMENT

Referring to the attached drawings, an example of a sheet finishing apparatus of the present invention will be described below.

Figure 1:
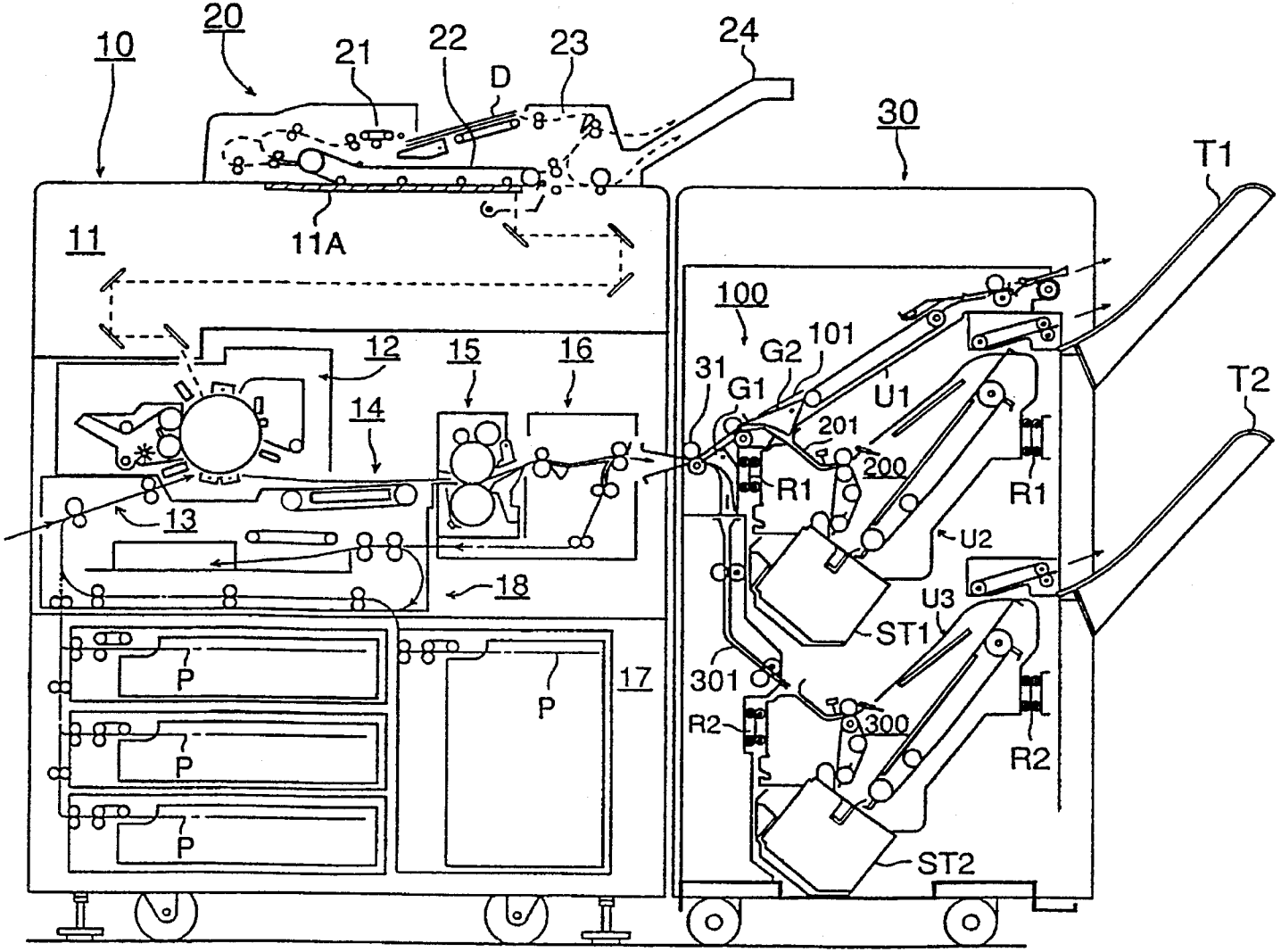
FIG. 1 is a view showing the overall structure of a copier provided with a sheet finishing apparatus of the present invention.

FIG. 1 is a view showing the overall structure of a copier provided with a sheet finishing apparatus. In FIG. 1, numeral 10 is the copier main body. Numeral 20 is a recirculating document handler (RDH apparatus), and numeral 30 is a sheet finishing apparatus (which is referred to as a finisher, or FNS apparatus, hereinafter).

The copier main body 10 comprises: a scanning exposure section 11; an image forming section 12; a sheet-feed section 13; a conveyance section 14; a fixing section 15; a delivery sheet switching section 16; a plurality of sheet-feed cassettes 17; and a sheet re-feeding apparatus for two-sided recording (automatic duplex unit, ADU apparatus) 18.

In FIG. 1, a conveyance path for a sheet P is shown by a one-dotted chain line. The conveyance path for a sheet P is composed of a main route and a circulation route, clarified as follows. After an image is formed on the sheet P by the image forming section 12, accommodated in the sheet-feed cassette 17, located in a lower portion of the copier main body 10, the sheet P is accommodated in an FNS apparatus 30 through the conveyance section 14, the fixing section 15, and the delivery sheet switching section 16, which is the primary route. After the sheet P has been branched from the delivery sheet switching section 16 and temporarily stocked in an ADU apparatus 18, the sheet P is fed again from the ADU apparatus 18, and conveyed to the sheet-feed section 13 in the copier main body 10, which is the circulation route.

Sheet feeding for a document D, placed on a document tray of the RDH apparatus 20, starts by depressing the copy button arranged on an operation panel of the copier main body 10. The document D is conveyed onto a platen glass 11A by a conveyance belt 22 through the sheet feed section 21, and positioned on an exposure position.

A document image of document D is read when the document image is exposed and scanned by the operation of the scanning exposure section 11. The document is fed through a reversal sheet delivering path when a conveyance belt 22 is rotated again after document reading, and accommodated in the lowest layer of the document sheets placed on the document tray.

The circulation sheet feeding operation of the document D is described above. However, the RDH apparatus 20 is provided also with an automatic document feeder ADF, and in this case, the document D, from which an image has been read, is advanced straight, and delivered and stacked on the delivery tray 24 through a sheet delivery roller.

A copying image of the document D, obtained by exposure scanning, is recorded on a sheet P fed by the sheet-feed cassette 17 through an image processing process.

The sheet P, on which the image is recorded, is temporarily sent to the ADU apparatus 18, and is reversed, and is delivered from the delivery sheet switching section 16 under the condition that the image surface faces downward. Then, the sheet P is fed to the FNS apparatus 30 of the present invention. The FNS apparatus 30 is arranged as follows. Its position and height are adjusted so that a receiving roller 31 is met with the delivery portion of the copier main body 10. The FNS apparatus 30 is connected to the control system so that the FNS apparatus is driven corresponding to operations of the copier main body 10.

The sheet P conveyance path, connected to the back portion of the receiving roller 31, is branched into an upper stage offset conveyance path 101 (the first conveyance path), the intermediate stage second conveyance path 201, and the lower stage third conveyance path 301. The sheet P is sent to any conveyance path corresponding to the selection angle of the switching gates G1 and G2. U1 is the first unit of which the first conveyance path is composed, U2 is the second unit of which the second conveyance path is composed, and U3 is the third unit of which the third conveyance path is composed.

Figure 2:
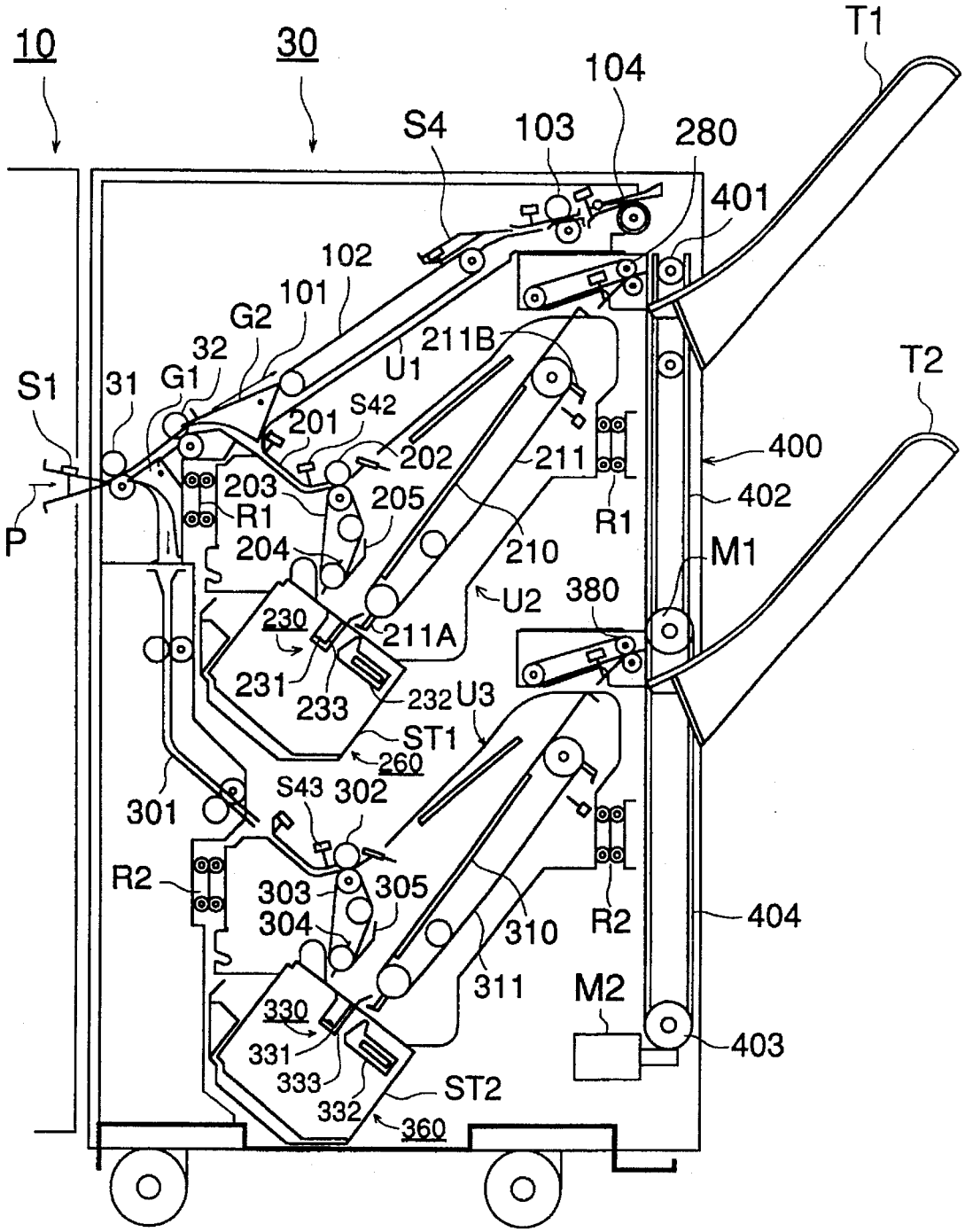
FIG. 2 is a sectional view of the sheet finishing apparatus.

FIG. 2 is a sectional view showing the structure of the FNS apparatus.

The sheet P is sent by a pair of conveyance rollers 202, provided on the second conveyance path 201, to the intermediate stacker 210 arranged at a predetermined inclination angle. An auxiliary conveyance belt member (a guide belt) is ratatably provided above the lower end inclination portion of the intermediate stacker 210, and sends the trailing edge portion of the sheet P to a stapler section. An auxiliary conveyance rotation member (a vaned wheel) 204 is provided on the lowest roller shaft, of three rollers, around which the guide belt 203 is wound. When the sheet P is switched back and lowered along the intermediate stacker 210, the sheet P comes into positive contact with a stopper 231, (which will be described later), by the slide-contact action of the vaned wheel 204. An oscillating delivery sheet pressure member 205 is supported on the same shaft as the roller shaft of the vaned wheel 204.

The intermediate stacker 210 is provided at a predetermined inclination angle, and its upper surface is at the same level as that of the upper surface of the delivery belt 211. The delivery belt 211 is wound around the drive roller 211A and a driven roller. A delivery claw 211A, for pushing and conveying volumes of the stapled sheets, and a protrusion 211B, for detecting a home position, are provided with the delivery belt 211.

Under the intermediate stacker 210 and the movable delivery belt 211, there are provided: a sheet transfer means 230 composed of a stopper member 231, sheet pressure member 232 and a sheet transfer lever 233; and a stapler unit 260 composed of a stapler ST1.

A sheet delivery means 280 composed of a pair of sheet delivery rollers is vertically provided at the downstream side of a sheet volume conveyance route of the intermediate stacker 210, near the sheet delivery section of the FNS apparatus 30.

The second conveyance path 201 is structured by the following on the downstream side of the switching gate G2: the conveyance section composed of a pair of conveyance rollers 202, a guide belt 203, the vaned wheel 204, and the delivery sheet pressure member 205; a sheet volume transfer means 230 composed of the stopper member 231, the sheet pressure member 232, and the transfer lever 233; the alignment means 240; the stapler unit 260 composed of the stapler ST1; the delivery section composed of the intermediate stacker 210 and the delivery belt 211; and the sheet delivery means 280. The conveyance section, sheet transfer means 230, alignment means 240, stapler unit 260 and delivery section are supported by a movable base plate of the second unit U2, and can be attached to and detached from the FNS apparatus 30 through a pair of horizontally provided guide rails R1. When the front door, shown in the drawing, is opened, the unit U2 is drawn out so that maintenance operations such as jamming processing or staple replenishing, etc., are carried out.

The third conveyance path 301 is structured by the following on the downstream side of the switching gate G1: the conveyance section composed of a pair of the conveyance rollers, guide belt 303, vaned wheel 304, and delivery sheet pressure section 305; the sheet transfer means 330 composed of the stopper member 331, sheet pressure means 332, and sheet transfer lever 333; the stapler unit 360 composed of stapler ST2; the intermediate stacker 310; the alignment means 340; the delivery section composed of the second delivery belt 311; and delivery sheet means 380. This structure is the same as that of the second conveyance path. The third unit U3 can be attached to and detached from the FNS apparatus 30 through the guide rail R2.

Further, a delivery sheet tray elevation means 400 is provided at the right portion of the FNS apparatus 30. A pair of supporting members 402 which move vertically, being engaged with a plurality of guide rollers 401, are provided in front and in the rear of the delivery sheet tray elevation means 400. The first sheet delivery tray T1 and the second sheet delivery tray T2 are independently moved vertically, being sandwiched by the supporting members 402.

The pair of supporting members 402 are respectively fixed to elevation wires 404 which are stretched between independent motors M1, M2 for exclusive use, and a pulley 403. The first sheet delivery tray T1 and the second sheet delivery tray T2 are independently and vertically moved parallelly, when the motors M1 and M2 are rotated.

Figure 3:
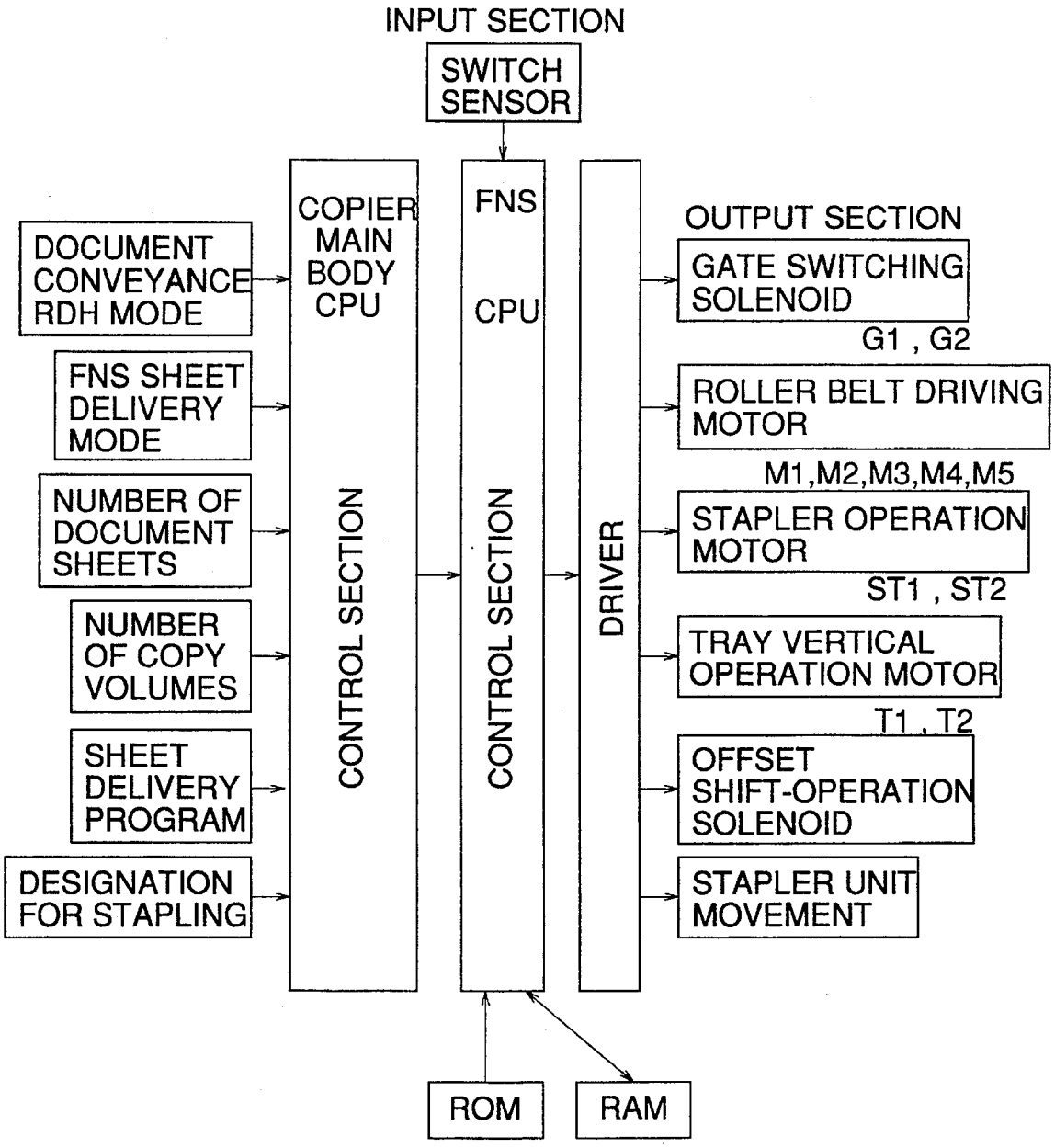
FIG. 3 is a block diagram showing the principles of a control system.

Control circuits accommodated in the copier main body 10 and the FNS apparatus 30 are composed of basic circuits as shown by the block diagram in FIG. 3. Before the start of the copying operation, a sheet delivery mode (a staple mode or non-sort mode) is selected, and the number of document sheets and the number of volumes of copying sheets are set.

When the non-sort mode (in which no stapling operation is necessary), is selected as the sheet delivery mode, the switching gates G1 and G2 are set at their initial positions. The sheet P advances directly, and is delivered through the first conveyance path (offset conveyance path) 101, composed of the receiving roller 31, intermediate roller 32, conveyance belt 102, offset roller 103, and delivery roller 104, and is stacked on the first sheet delivery tray T1 located at the upper stage.

When the offset mode is selected as the sheet delivery mode, the switching gates G1 and G2 are set at their initial positions, the sheet P is sent to the first conveyance path 101 while the surface of the sheet P faces upward. Then, the sheet P is delivered onto the sheet delivery tray T1 through the conveyance belt 102, a pair of offset rollers 103, one of which is shift-driven, and the sheet delivery roller 105. The pair of offset rollers 103 composed of a driving roller and a driven roller, is provided with an offset driving section, which is reciprocated perpendicularly to the surface of the drawing. After passage of the trailing edge of the delivered sheet P has been detected (by sensor S4), the pair of offset rollers 103 are shift-driven, and respective volumes of sheets P are alternately shifted perpendicularly to the direction of sheet delivery and stacked, so that each volume of sheets can be easily sorted.

When the staple mode is selected as the sheet delivery mode, the switching gate G2 is rotated. The sheet P, sent by the receiving roller 31, advances directly to the second conveyance path 201, and is sandwiched between a pair of conveyance rollers 202 provided in the second unit U2. The sheet P is pushed up and temporarily stacked on the intermediate stacker 201. Continuously, the trailing edge of the sheet P slides down on the inclined surface of the intermediate stacker 210 by the rotation of the guide belt 203 and the weight of the sheet P. Then, the sheet P is introduced into the stapling portion of the stapler ST1 (a stopper member 231 of the sheet transfer means 230).

After, the last sheet of the sheets P of the first volume of sheets, which corresponds to the total number of document sheets, has been detected by the sensor S1, the switching gate G1 is rotated. The sheet P of the second volume of sheets is sent to the third conveyance path 301 in such a manner that the surface of the sheet P of the second volume faces downward. Then, the following operations start. The sheets P are pushed up and stacked on the stacker 310 by the guide belt 303, in the same manner as described above. In this connection, the structure of the sheet transfer means 333 of the third unit U3 is the same as that of the sheet transfer means 233 of the second unit U2.

On the other hand, all sheets P of the first volume, in which stacking of the first volume has been completed during feeding of the sheets P of the second volume, are stapled by the stapler ST1. The stapled sheets P are pushed up against gravity, and remain at a predetermined position on the intermediate stacker 210 by the push-up operation of the sheet transfer lever 233.

While the delivery belt 211 starts its rotation, through gears or a mechanical power transmission means composed of a belt, by a driving motor, and pushes up the rear end of the sheets P by the delivery claw 211A, and the delivery belt 211 makes one turn and stops, the delivery belt 211 delivers the stapled first volume of sheets on the first delivery sheet tray T1.

During this operation, stacking of the second volume of sheets P is completed, and the switching gate G2 returns again to its original position. Further, the stapled second volume of sheets P is delivered onto the second delivery sheet tray T2 by the operation of the stapler ST2.

As described above, since a plurality of volumes of sheets P, on which the image has been recorded, are individually collated and stapled in parallel at two vertically located places, finishing of the sheets P can be quickly carried out.

The motors M1 and M2 are operated corresponding to the amount of delivery of the sheets P, and the first sheet delivery tray T1 and the second sheet delivery tray T2 are lowered corresponding to the number of processed sheets, so that more delivered sheets P can be stacked.

Figure 4:
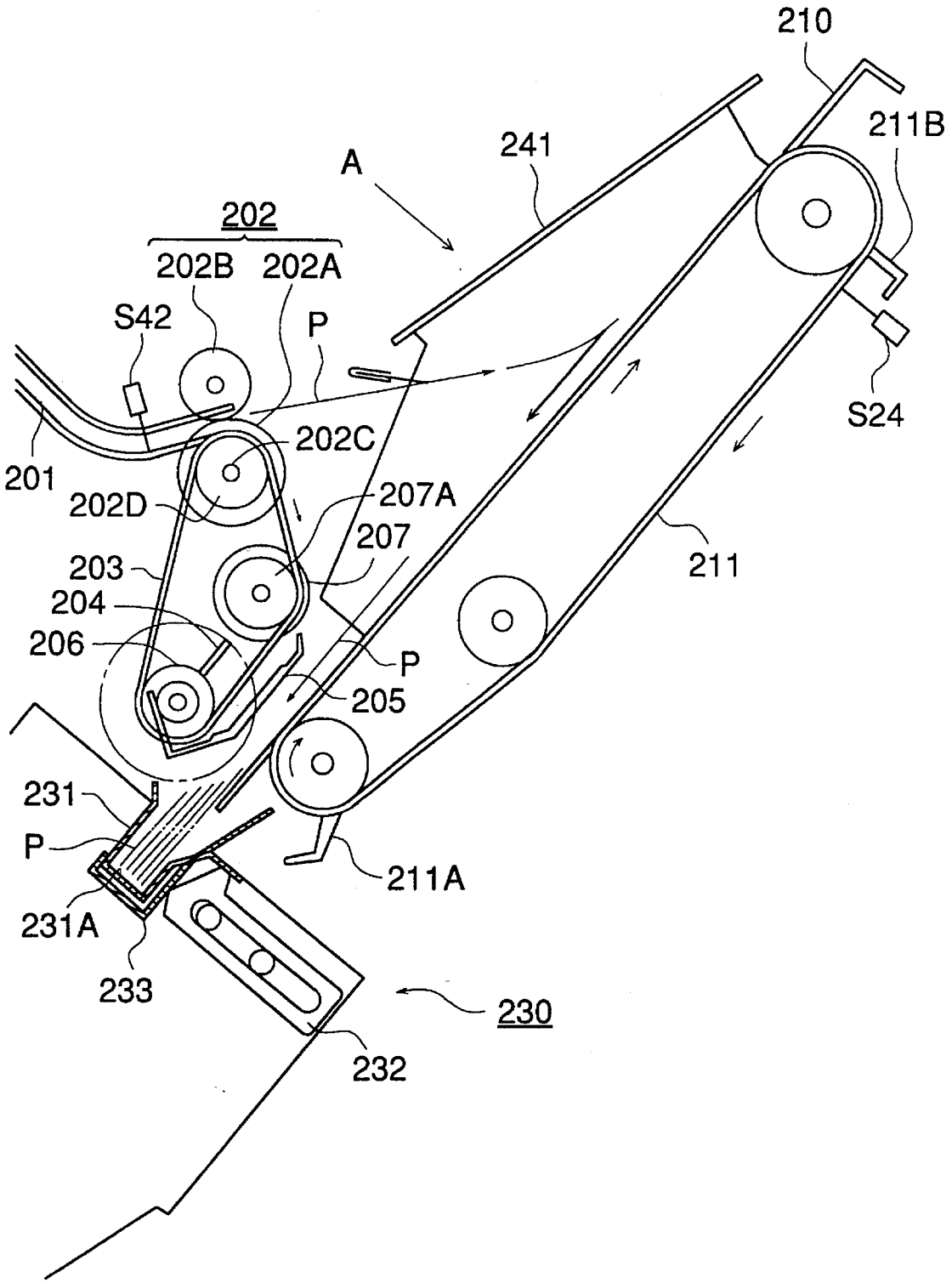
FIG. 4 is a sectional view of a sheet receiving portion and a sheet delivery portion.
Figure 5:
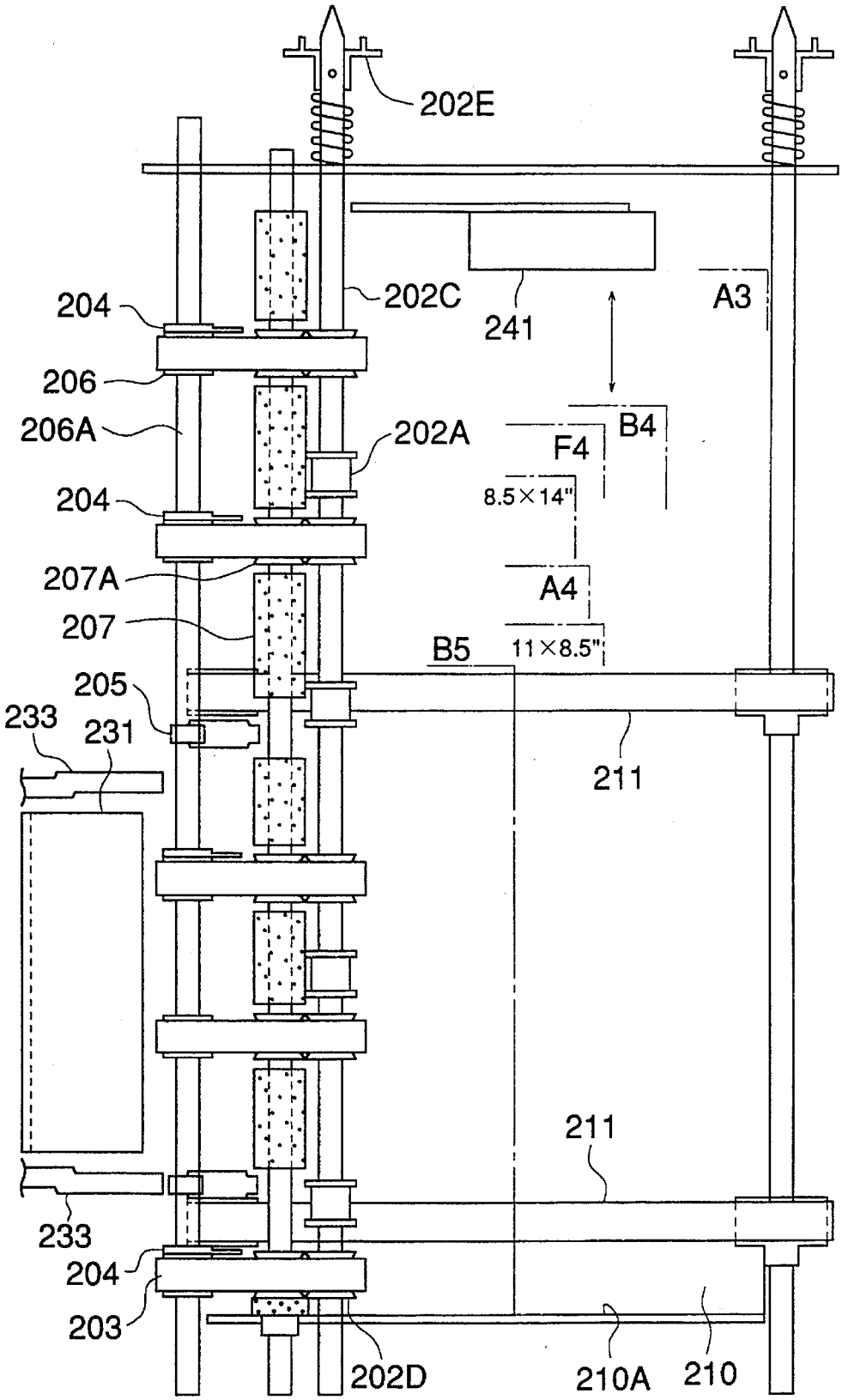
FIG. 5 is a plan view of the sheet receiving portion and the sheet delivery portion, viewed in the direction of an arrow A in FIG. 4.
Figure 6:
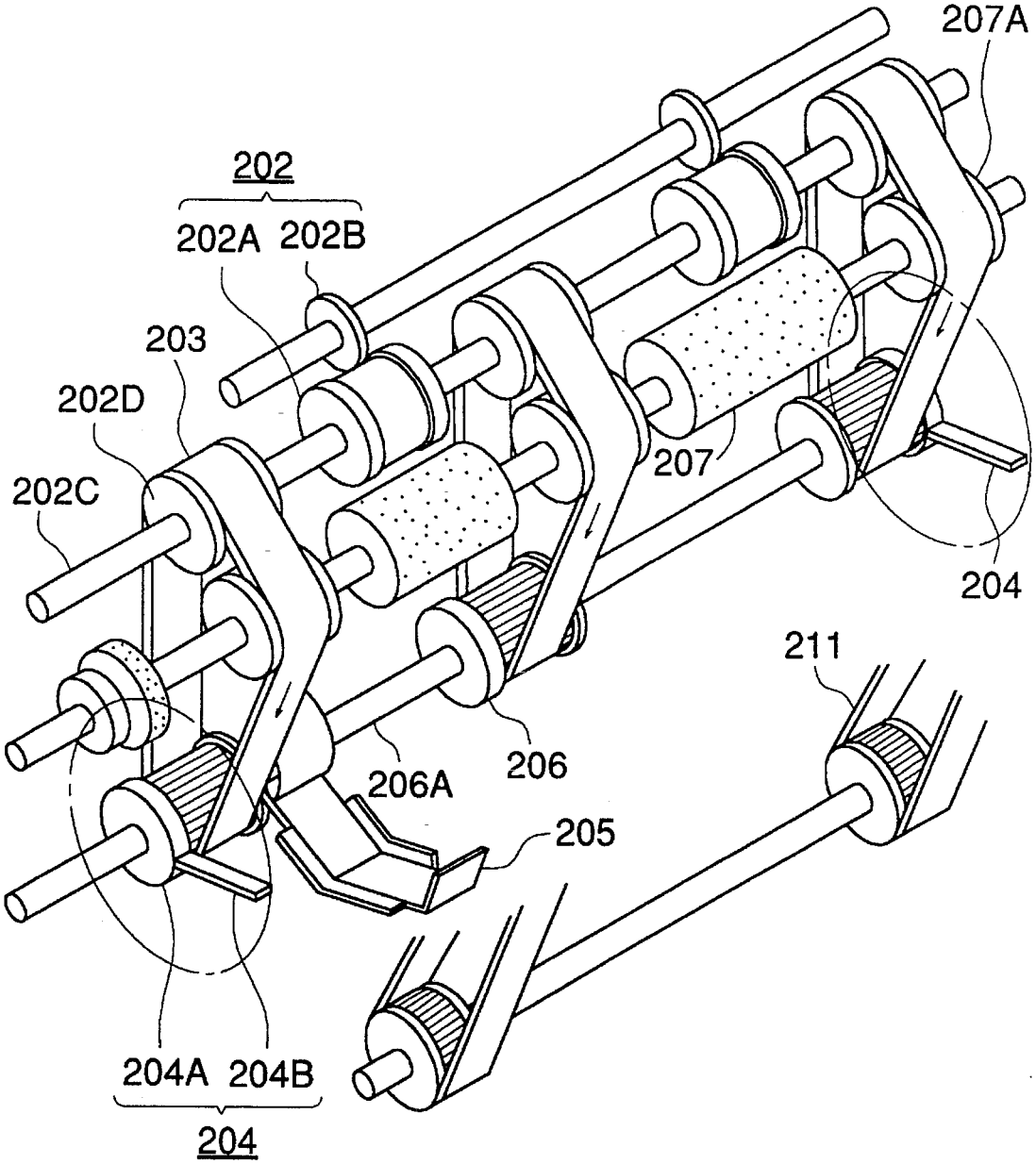
FIG. 6 is a partial perspective view of a conveyance means.

FIG. 4 is a view showing a sheet receiving section and a sheet delivery section. FIG. 5 is a plan view of the sheet receiving section and the sheet delivery section viewed from an arrow A in FIG. 4. FIG. 6 is a partial perspective view of a conveyance means. These figures show a sheet conveyance means in the second conveyance path 201. Since the third conveyance path 301 has the same structure as these figures, the second conveyance path 201 will be explained as a representative structure hereinafter.

The sheet P conveyed from the guide plate of the second conveyance path 201 is sandwiched between a pair of conveyance rollers 202, composed of a rotating driving roller 201A and a driven roller 202B, and is placed on the surface of the intermediate stacker 210 in such a manner that the sheet P is pushed up. The driving shaft 202C of the driving roller 202A is connected to a drive source, not shown, through a coupling 202E and is thereby rotated. A plurality of pulleys 202D are fixed on the driving shaft 202C. A guide belt 203, wound on the driving pulleys 202D, is an endless belt. By this belt, a plurality of driven pulleys 206, provided on the bottom portion of the inclined surface for sheet stacking of the intermediate stacker 210 and also provided above the stopper member 231, and a tension pulley 207A are also wound.

The guide belt 203 is located at a predetermined position corresponding to the size of each conveyed sheet (about 7 sizes from B5 (182×257 mm) to A3 (297×420 mm)). A plurality of winding rollers 207, made of a forming elastic body, are integrally formed on the same shaft as the tension pulleys 207A.

The plurality of driven pulleys 206 are supported and fixed on the rotation shaft 206A. The auxiliary conveyance rotation members (vaned wheels) 204 are fixed on the rotation shaft 206A, adjoining the driven pulleys 206, and rotated integrally with the rotation shaft 206A. The auxiliary conveyance rotation member 204 is composed of a hub portion 204A, which is engaged with and fixed on the rotation shaft 206A, and at least one sheet of thin elastic strip 204B, which protrudes from the hub portion 204A.

When the auxiliary conveyance rotation member 204 is rotated, the tip portion of the elastic strip portion makes a circular locus. A distance (a gap), in which the circular locus is closest to the sheet stacking surface of the intermediate stacker 210, is set to be smaller than the maximum thickness of the sheet volume stacked on the intermediate stacker 210. That is, when the number of sheets P stacked on the intermediate stacker 210 is small, the sheet P, conveyed through the second conveyance path 201 and a pair of the conveyance rollers 202, is reversely moved on the intermediate stacker 210, and easily slides downward on the sheet volumes due to the inclination angle of the intermediate stacker 210 and the weight of the sheet P itself. The trailing edge of the sheet P is easily advanced into a C-shaped frame of the stopper member 231, and comes into contact with the stopper surface, so that the trailing edges of all sheets are aligned. When the number of sheets stacked on the intermediate stacker 210 is increased, and height of the sheet volume is also increased (about 30–50 sheets), the trailing edge of the sheet P, the movement of which is switched backward and which slides downward on this sheet volume, is turned over and does not positively enter into the frame of the stopper member 231. Sometimes, the trailing edge of the sheet P then comes into contact with the vicinity of the frame entrance and is turned over, resulting in jamming.

The auxiliary conveyance belt member 203 guides the trailing edge of the sheet P, which slides down in the direction of stopper member 231, along the rotating belt surface. Further, in the auxiliary conveyance rotation member 204, the trailing edge of the sheet P, which is sliding down, is lightly struck by the elastic strip 204B, and the sheet volume, which is bulkily stacked on the intermediate stacker 210, is lightly pressed and conveyed. Then, the sheet volume is firmly brought into contact with the stopper surface 231A of the stopper member 231.

It is most effective that the auxiliary conveyance rotation member 204 is rotated in the vicinity of the entrance portion of the stopper member 231, at the portion just ahead of the stapler. Accordingly, the installation position of the auxiliary conveyance rotation member 204 is determined as follows. It is set at the position in which the rotation locus of the elastic strip 204B approaches about 7 mm above the upper surface of the intermediate stacker 210, which is the position at which the thickness of sheet volume exceeds about 30 sheets, so that the rotation member 204 does not come into contact with the stapler opening portion.

Sheets P, stacked on the intermediate stacker 210, are placed between the reference surface 210 of the intermediate stacker 210 and the movable alignment plate 241, and aligned.

Sheet P, conveyed onto the intermediate stacker 210, is brought into contact with the stopper member 231 by three auxiliary conveyance belt members 203 and three auxiliary conveyance rotation members 204, so that the trailing edges of the sheets P are aligned, in the case where the size of the sheet P is B5, which is the minimum size, and A4. When the size of the sheet P is B4, the trailing edges of the sheets P are aligned by four sets of auxiliary conveyance belt members 203 and the auxiliary conveyance rotation members 204. When the size of the sheet P is A3, the trailing edges of the sheets P are aligned by five sets of auxiliary conveyance belt members 203 and the auxiliary conveyance rotation members 204.

Figure 7:
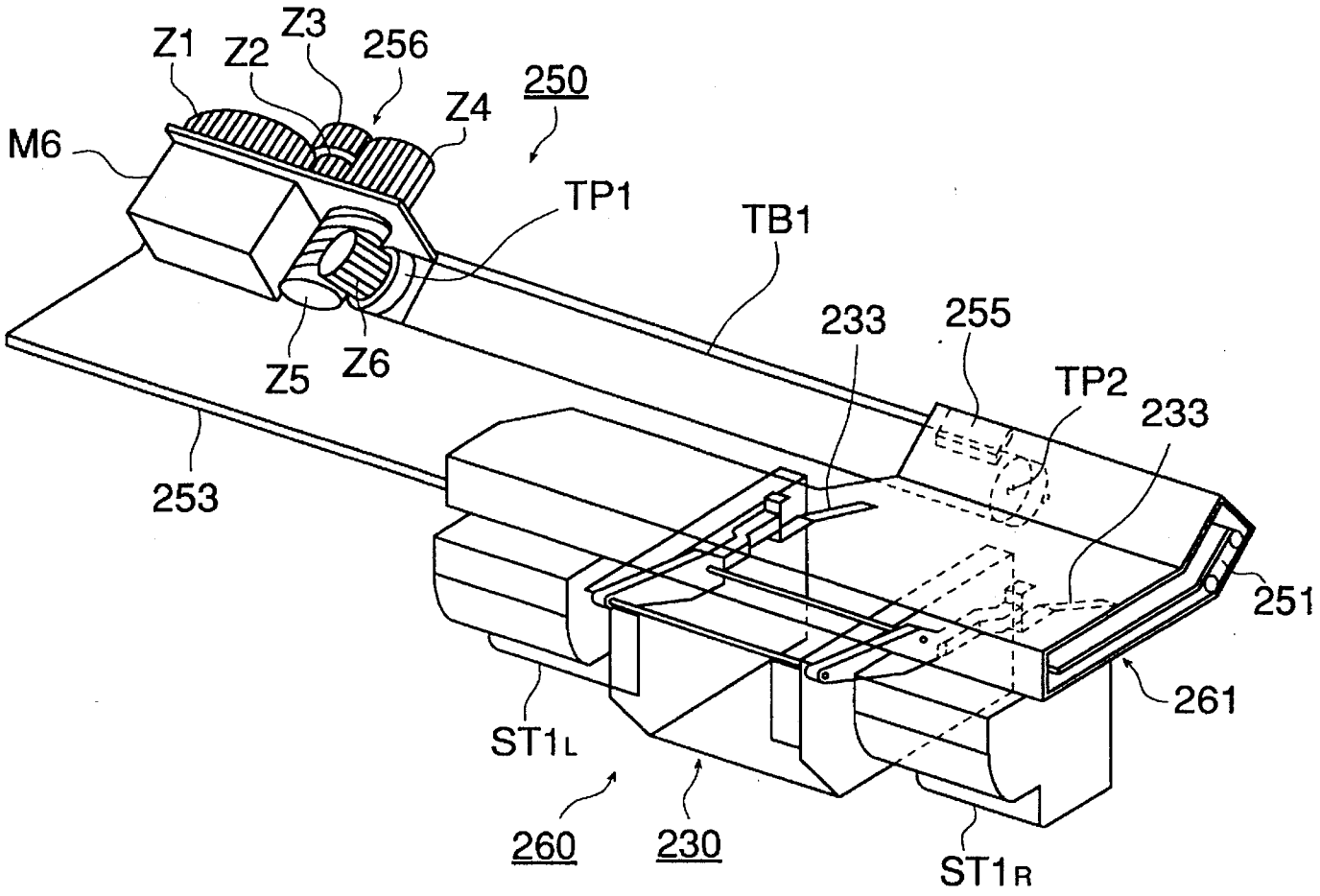
FIG. 7 is a perspective view of a stapler unit and a moving means.

FIG. 7 is a perspective view of the stapler unit 260, composed of staplers $ST1_R$ and $ST1_L$, the sheet transfer means 230, and the movement means 250. In this connection, since the stapler unit 260 and the movement means 250, which are provided at the downstream position of the upper stage second conveyance path 201, have approximately the same structure as the stapler unit 360 and the movement means, which are provided on the lower stage third conveyance path 301, the structure and operations of the stapler unit 260 and the movement means, which are provided at the downstream of the upper stage second conveyance path 201, will now be explained.

The sheet transfer means 230 and staplers $ST1_R$ and $ST1_L$ are integrally provided with the stapler unit 260 on the movement base plate 261, and these components can slide on a fixed base plate 253 by a slide rail 251 and a slide roller, not shown. A portion of a rotatable timing belt TB1, which is wound around a drive pulley TP1, connected to a drive source (stepping motor M6), and a driven pulley TP2, is fixed by an engagement member 255 on the fixed base plate 253. The drive pulley TP1 is connected to the drive source, that is, the stepping motor M6, through a gear train 256 composed of gears Z1, Z2, Z3, Z4, Z5 and Z6. The sheet transfer means 230 and the stapler unit 260, composed of stapler $ST1_R$ and $ST1_L$, are moved to a specified position by the drive of the stepping motor M6 and a control means.

Figure 8A:
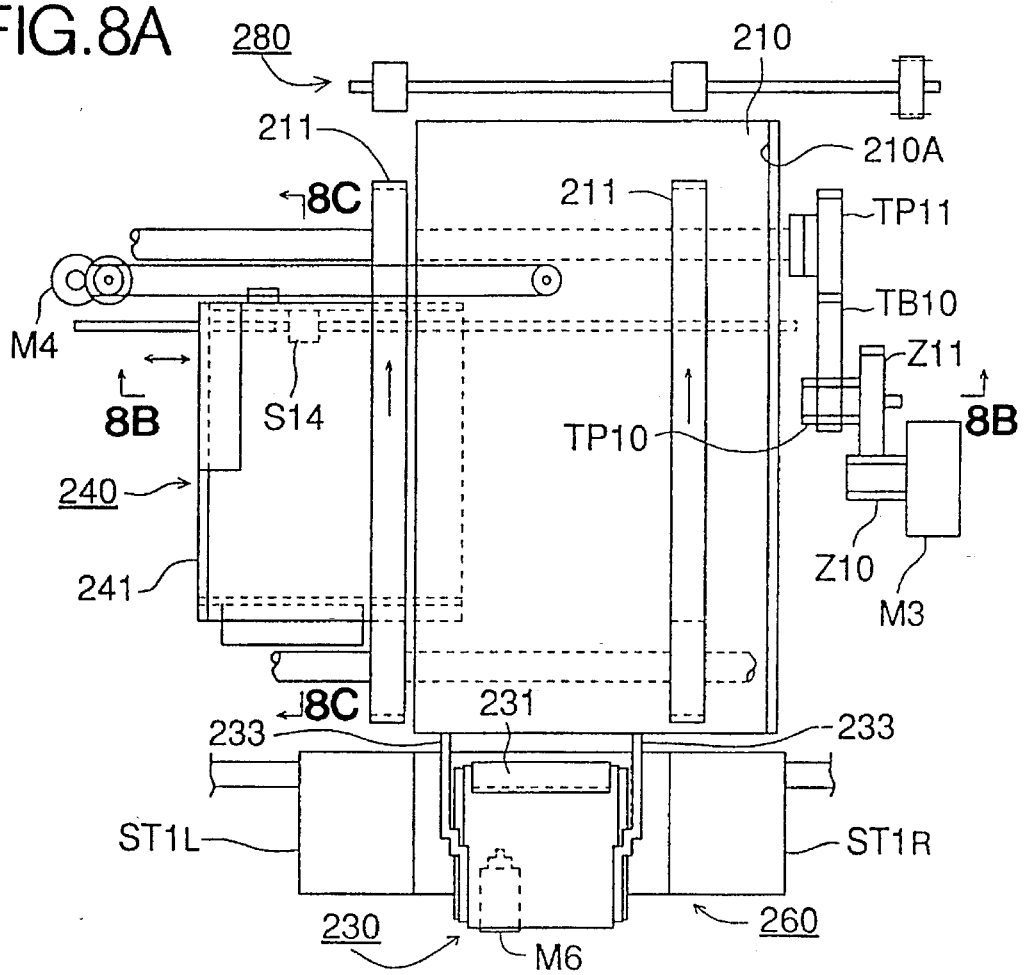
FIG. 8(*a*) is a sectional view of an alignment means, stapler unit and sheet delivery portion.
Figure 8B:
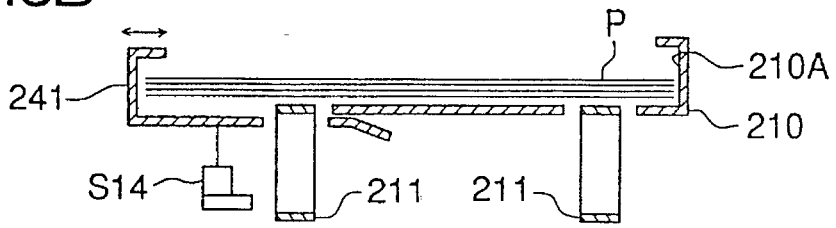
Figure 8C:
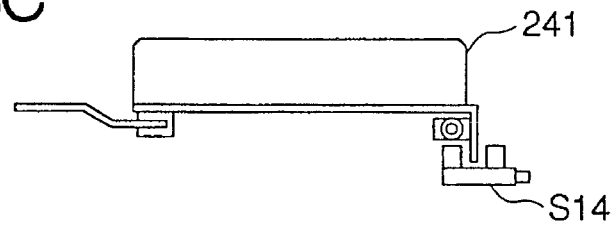
Figure 9A:
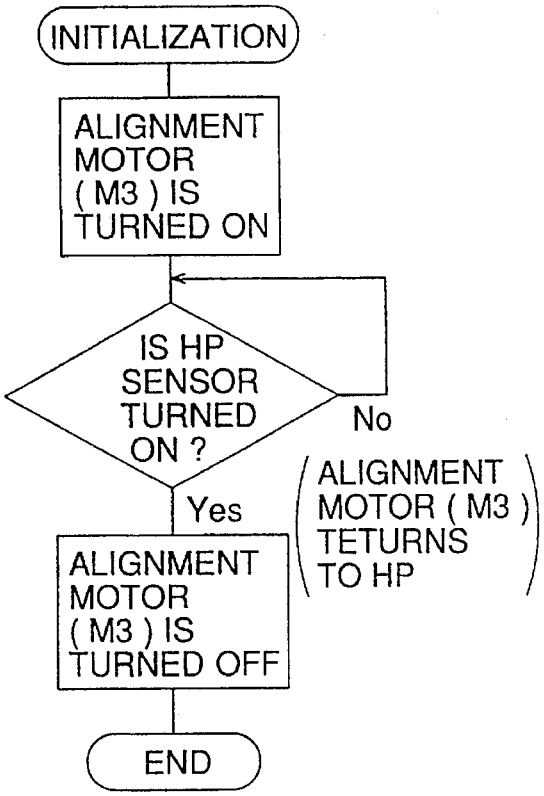
FIG. 9(*a*) through FIG. 9(*d*) are flow charts showing operation processes of an alignment means.
Figure 9B:
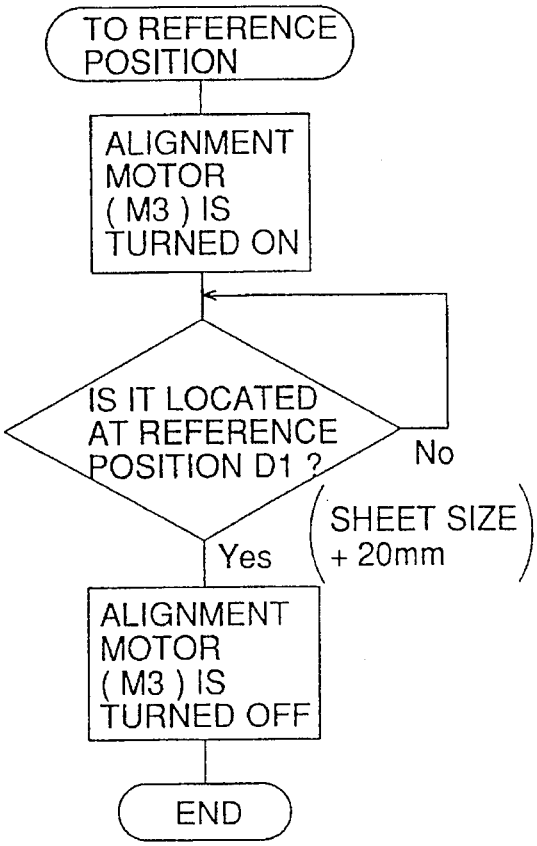
Figure 9C:
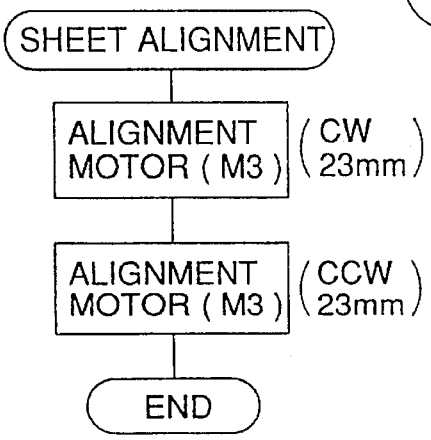
Figure 9D:
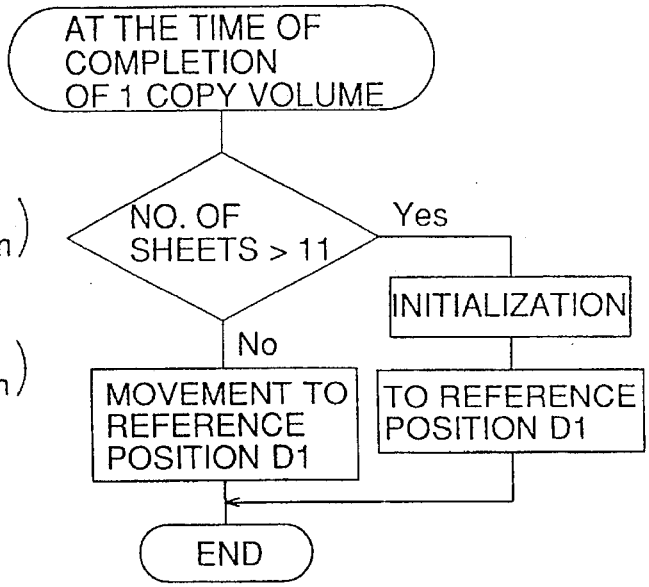

FIG. 8(*a*) is a plan view of the alignment means 240, the stapler unit 260, and a sheet delivery section. FIG. 8(*b*) is a sectional view taken on line A—A in FIG. 8(*a*). FIG. 8(*c*) is a sectional view taken on line B—B in FIG. 8(*a*). Numeral 240 is the alignment means for aligning the width of sheets P stacked on the intermediate stacker 210.

A transfer lever 233 of the sheet transfer means 230 is reciprocally operated only at the time of delivery of the stapled sheet volume.

The delivery belt 211 starts rotation in the arrowed direction by the drive of the stepping motor M3 through gears Z10, Z11, timing pulleys TP10, TP11, and the timing belt TB10. While the trailing edge of sheets P are pushed up by the delivery claw 211A, and the delivery belt makes one turn and stops, the stapled first volume of sheets P is delivered onto the first sheet delivery tray T1.

Further, during the above operations, the stacking operation of the second volume of the sheets P has been completed, and the switching gate G2 has returned again to its initial position. Simultaneously, the stapling operation for the second volume of the sheets P is carried out by the stapler ST2, and the stapled second volume of sheets P is delivered onto the second delivery sheet tray T2 by the rotation of the delivery belt 311, in the same way as described above for the first volume.

As described above, according to the FNS apparatus 30 of the present invention, a plurality of volumes of sheets P, on which an image has been recorded, can simultaneously be collated and stapled parallelly at two positions. Accordingly, finishing operations of the sheets P are more quickly carried out.

Motors M1 and M2 are operated corresponding to the delivery amount of the sheets P, and the first sheet delivery tray T1 and the second sheet delivery tray T2 are lowered corresponding to the amount of sheets to be processed, for easy delivery of sheets P.

When the staplers ST1 and ST2 are respectively provided at one position ($ST1_R$) on the intermediate stackers 210 and 310, the upper left portion of the sheets P can be stapled by the stapler, in the case where the sheets P are longitudinally placed and delivered. However, when the stapler $ST1_L$ is additionally provided on the stacker, the stapling operations can be carried out by two staplers. Further, when the sheets P are delivered in such a manner that the sheet P is transversely placed in the advancing direction, the upper left portion can be stapled.

Figure 16A:
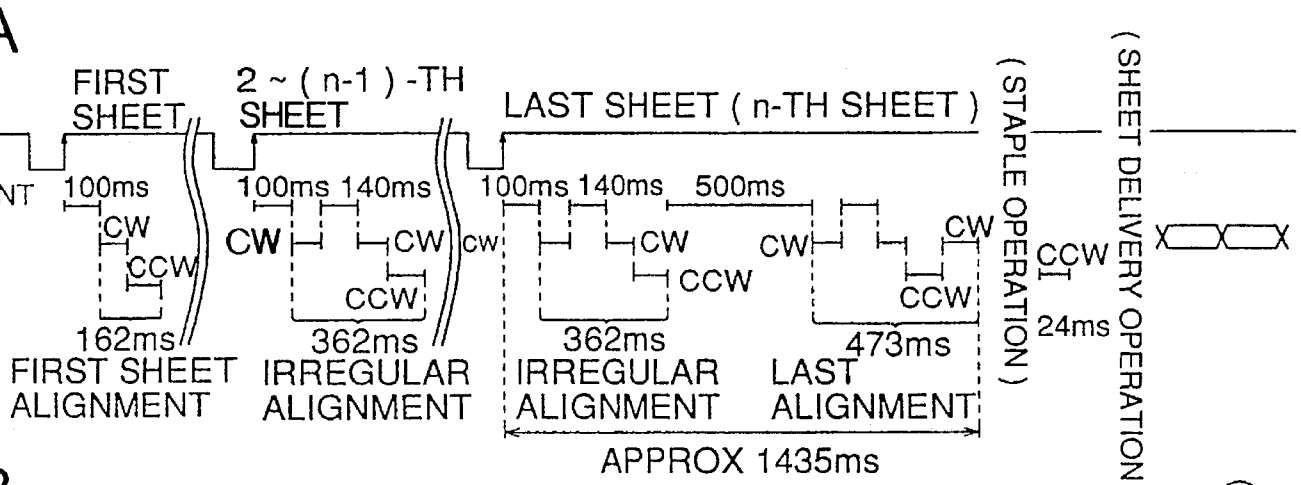
FIG. 16(*a*) and FIG. 16(*b*) are time charts of the alignment means.
Figure 16B:
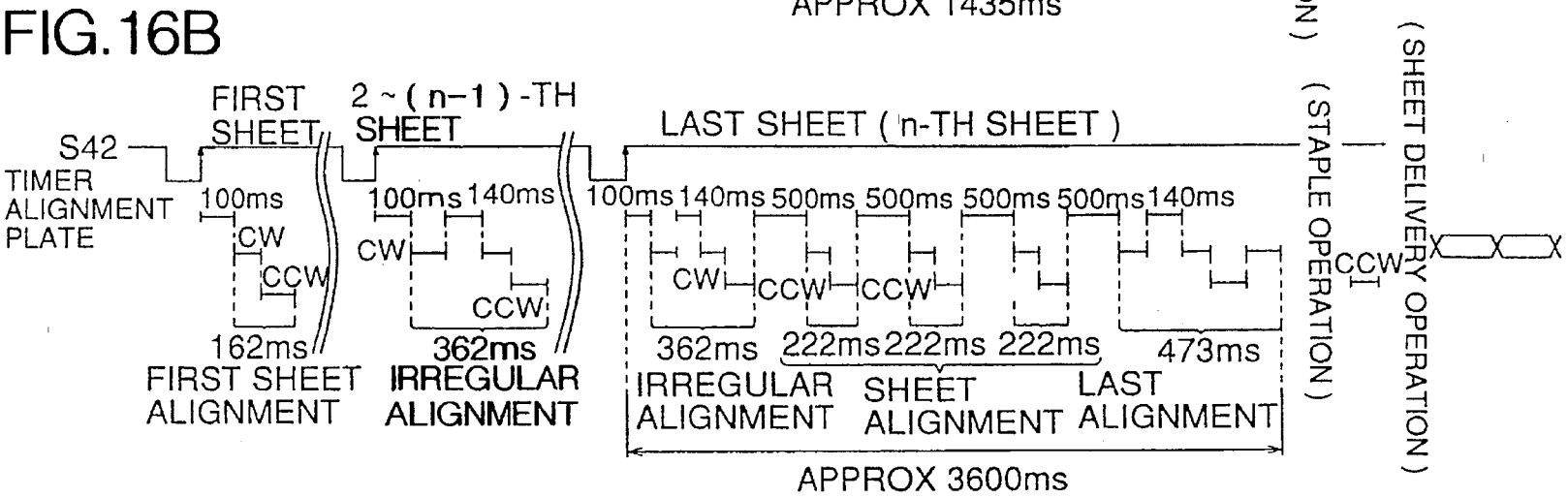
Figures 1, 17B:
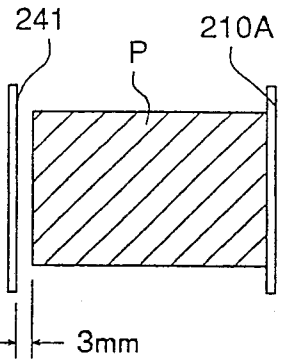
Figures 2, 17B:
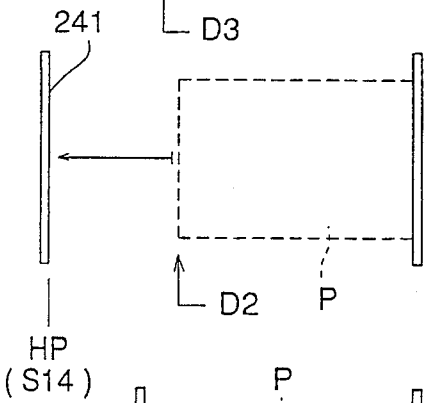
Figures 3, 17B:
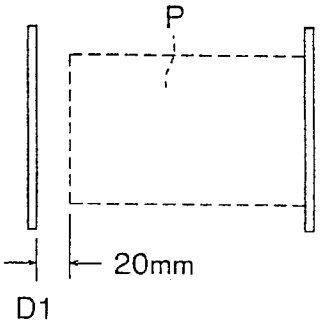
Figures 1, 17A:
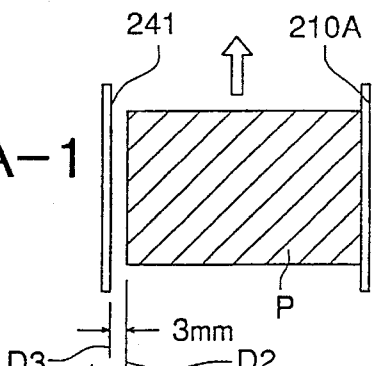
Figures 2, 17A:
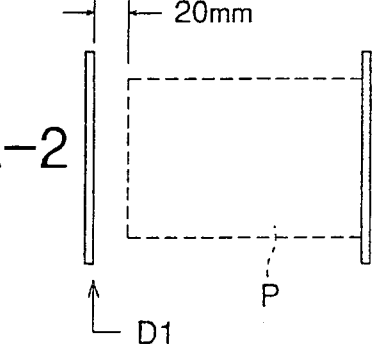

Referring to FIG. 9(*a*) through FIG. 16(*b*), alignment processes of the present invention will be explained below.

FIGS. 9(*a*) through 9(*d*) are flow charts showing operation processes of the alignment means 240. FIG. 9(*a*) shows an initializing operation of the alignment means 240 at the start of operations of the sheet finishing apparatus 30. In FIG. 9(*a*), an alignment motor (a stepping motor) M3 is driven, and after an movable alignment plate 241 has been positioned at its home position HP, the motor temporarily stops and is ready for the next operations.

FIG. 9(*b*) shows operations in which the alignment motor M3 is driven and the movable alignment plate 241 is positioned at the reference position for waiting D1. By this operation, the movable alignment plate 241 is stopped at the reference position for waiting D1 which is 20 mm separated from a sheet width side edge position D2 shown in FIGS. 10(*a*) and 10(*b*).

Figure 10A:
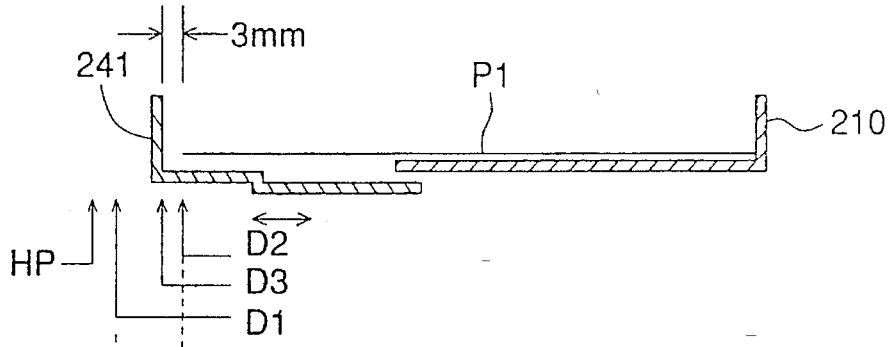
FIGS. 10(*a*), 10(*b*) and 10(*c*) are sectional views for explaining stop positions of the movable alignment plates of the alignment means.
Figure 10B:
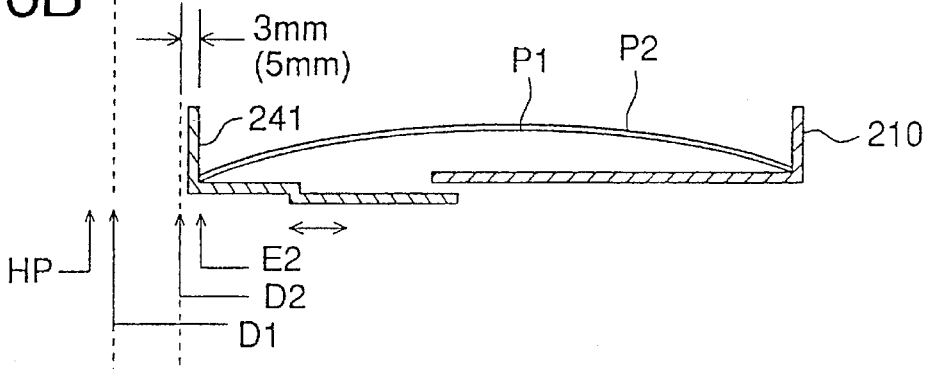
Figure 10C:
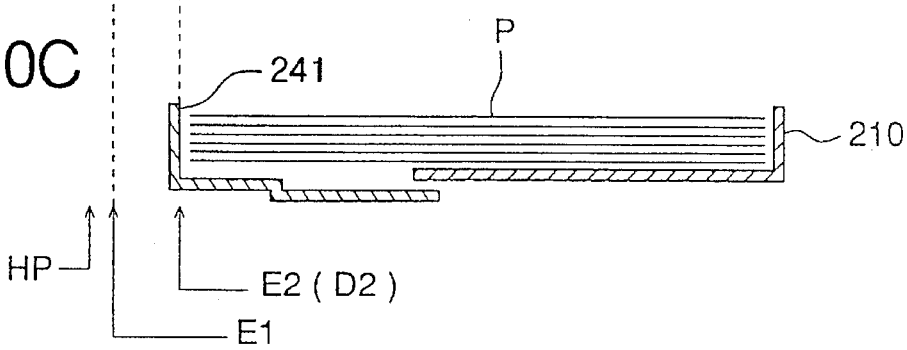

FIG. 9(*c*) shows a paper alignment operation, by which paper alignment is repeated corresponding to a CW advance movement amount of 23 mm, and a CCW backward movement amount of 23 mm of the movable alignment plate 241, shown in FIGS. 10(*a*) and 10(*b*).

FIG. 9(*d*) shows operations of the movable alignment plate 241 when copying operations for one volume of sheets have been completed. When the number of copying sheets for one volume is not more than a predetermined set value (for example, 11 sheets), the movable alignment plate 241 starts for paper alignment operations from the reference position for waiting D1 and completes the operations, each time a sheet P is received. When the number of copying sheets for one volume is not less than the predetermined set value (for example, 11 sheets), after the initializing operation, shown in FIG. 9(*a*), has been carried out, the movable alignment plate 241 returns to the reference position of waiting D1, and the operation is completed. Accordingly, when the number of sheets is small, the copying efficiency is decreased corresponding to the forward and backward movement times when the movable alignment plate 241 returns to the home position. Therefore, the movable alignment plate 241 does not return to the home position HP in the above case. Only when a large number of sheets are aligned, the movable alignment plate 241 returns to the HP, considering step-out of the stepping motor.

In this connection, the reference position for waiting D1 is set such that a predetermined distance is previously set corresponding to the sheet width with respect to a plurality of types of sheets, and it is not limited to the 20 mm in the above example. In the same way as will be described, the CW advancing movement amount of 23 mm, and the CCW backward movement amount of 23 mm, and the waiting position (D3) for one copy volume of sheets of 3 mm, of the movable alignment plate 241, are not limited in the present invention.

Figures 1, 2, 3, 4, 11A, 11B:
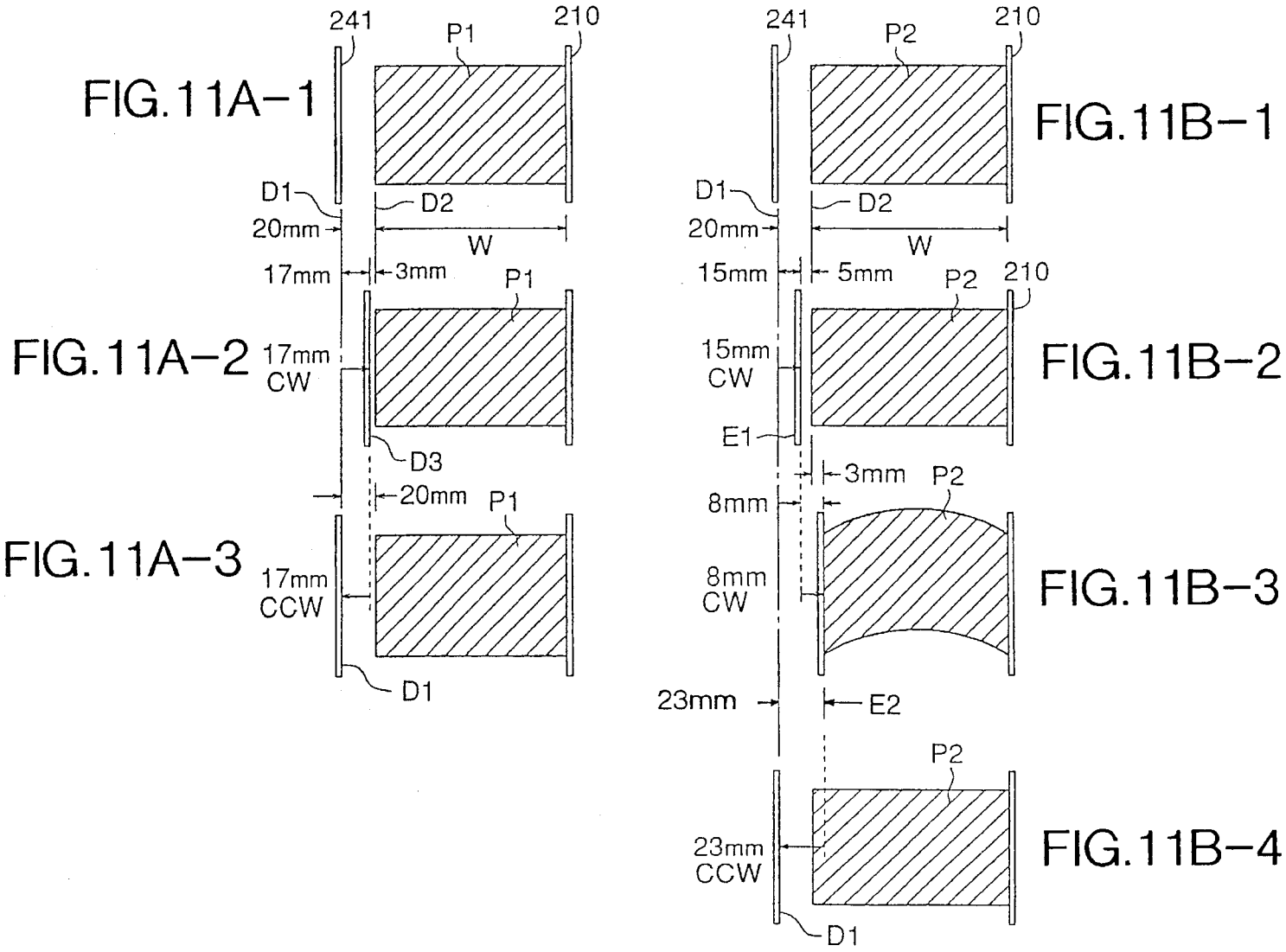
Figure 12A:
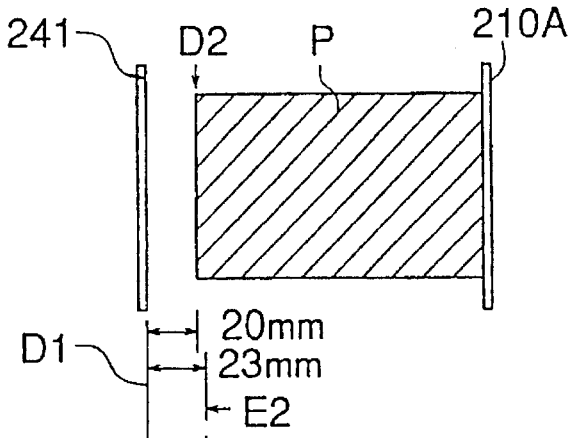
FIG. 12(*a*) through FIG. 12(*e*) are plan views for explaining stop positions of the movable alignment plates for sheet alignment.
Figure 12B:
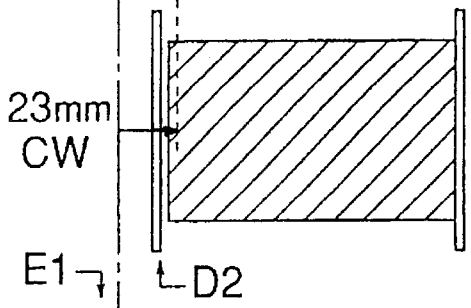
Figure 12C:
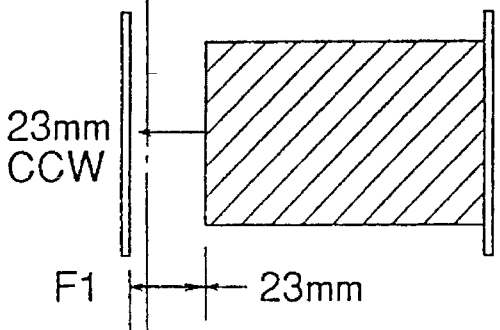
Figure 12D:
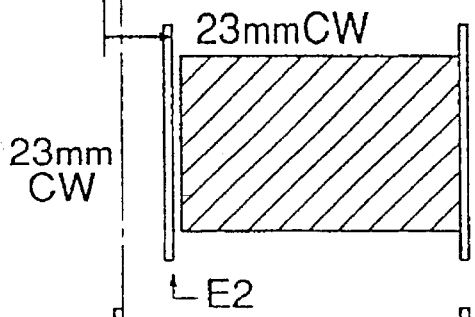
Figure 12E:
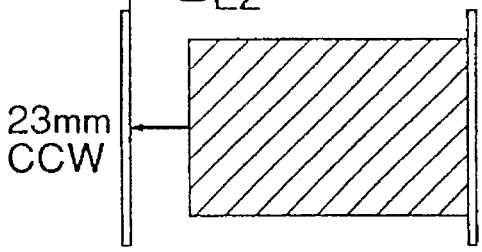
Figure 13:
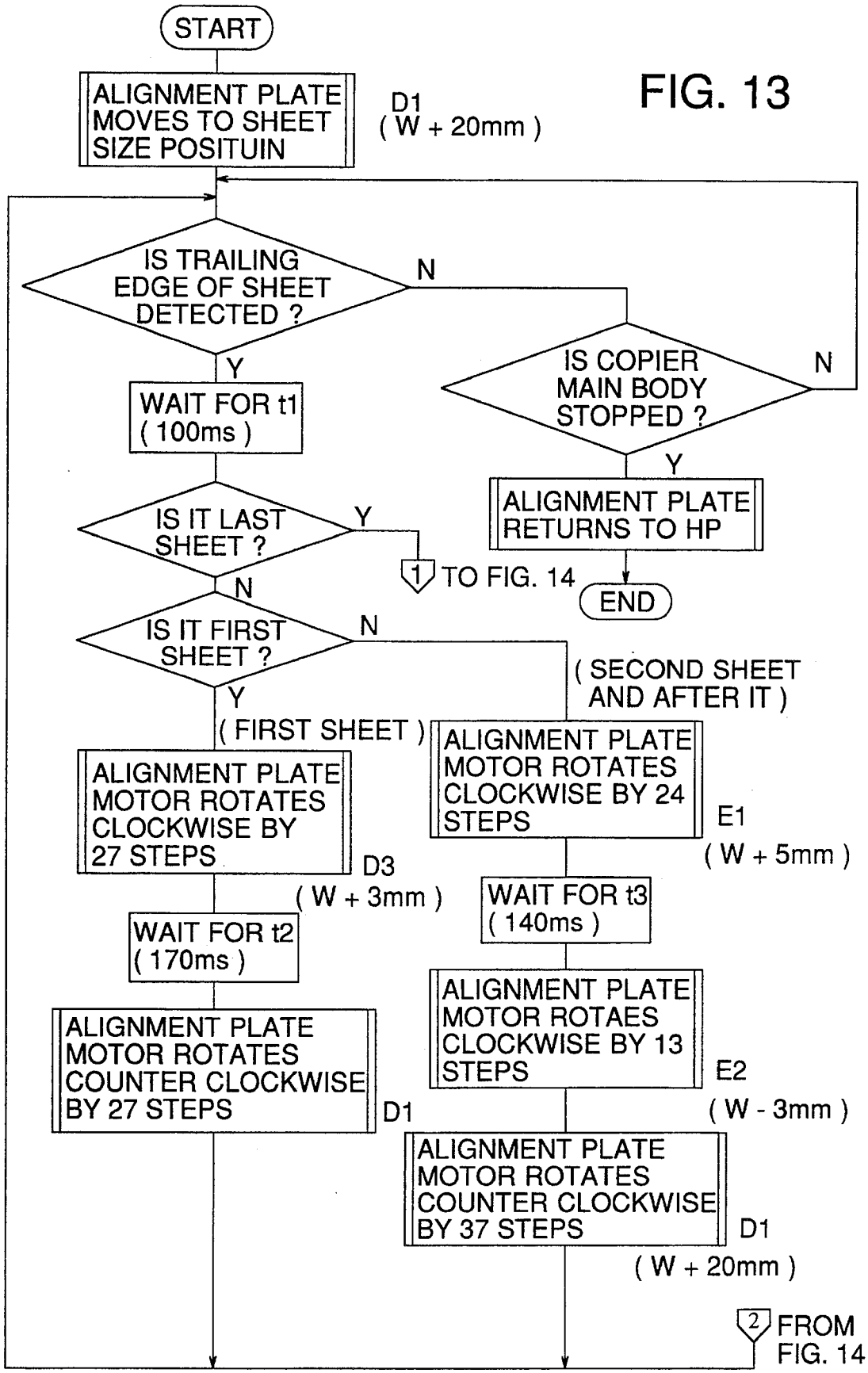
FIG. 13 is a flow chart showing an operation process of the alignment means.
Figures 15A, 15B:
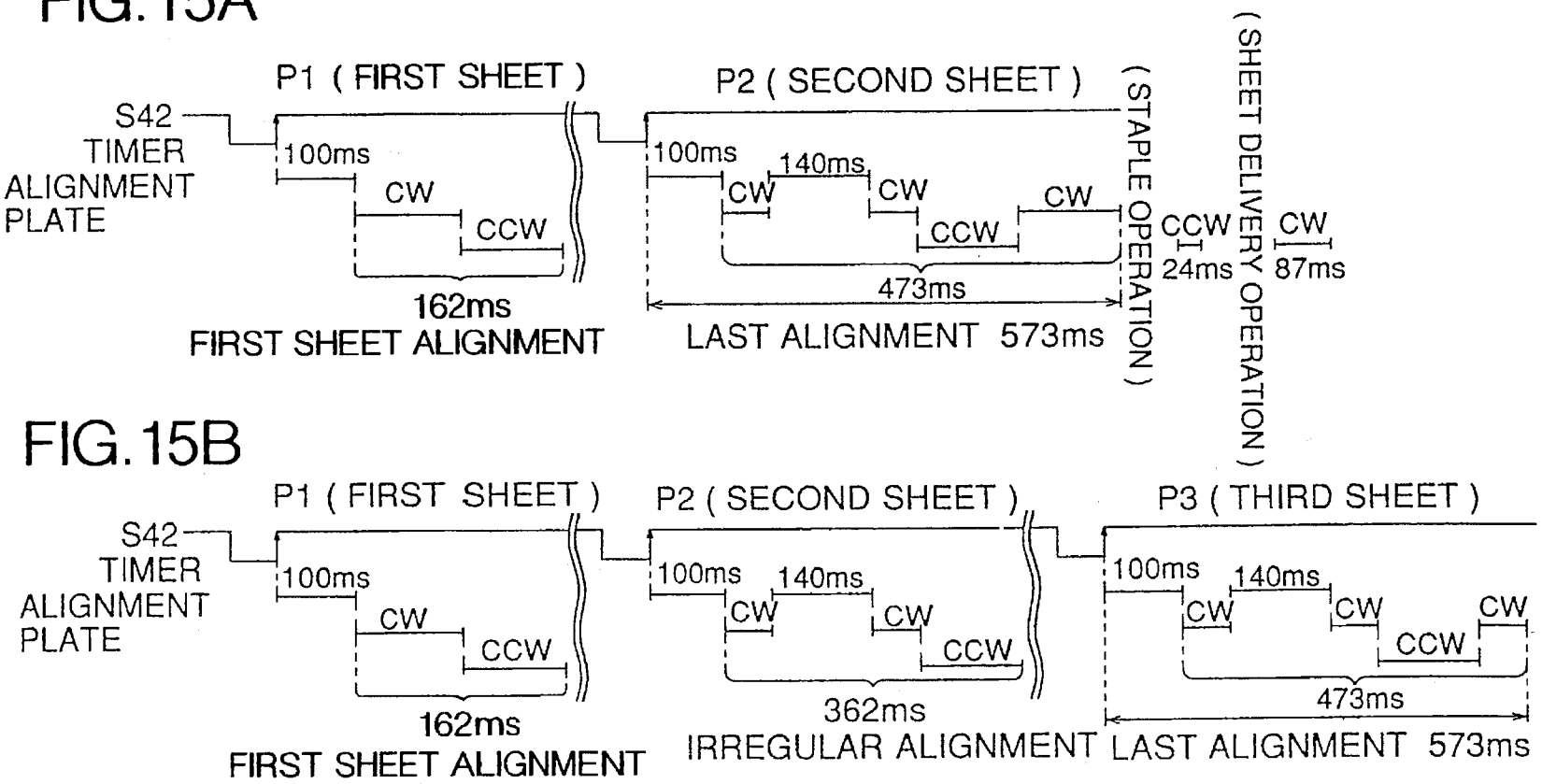
FIGS. 15(*a*) and 15(*b*) are time charts of the alignment means.

FIGS. 10(*a*), 10(*b*) and 10(*c*) are sectional views for explaining each stop movement position of the movable alignment plate 241 of the alignment means 240. FIG. 11(*a*-1) through FIG. 11(*b*-4), and FIG. 12(*a*) through FIG. 12(*e*) are plan views for explaining each stop movement position of the movable alignment plate 241 at the time of the sheet alignment. FIGS. 13 and 14 are flow charts showing operation processes of the movable alignment plate 241 of the alignment means 240. FIGS. 15(*a*) and 15(*b*), FIGS. 16(*a*) and 16(*b*) are time charts for the alignment means 240.

Referring to these drawings, the alignment processes will be explained in detail below.

① The number of copy volume of sheets and a set value (N1) of the number of sheets for each volume are sent from a copier main body by a communication means.

② When the size of the sheet P, conveyed into the sheet finishing apparatus 30, is sent from the copier main body 10, the movable alignment plate 241 of the alignment means 240 is ready for the next operation at the reference position for waiting D1 (the sheet width W+20 mm), which is separated by 20 mm outside of the side edge in the direction of the width of the sheet P (refer to FIG. 11(*a*-1)). At this position D1, the leading edge of the sheet P is conveyed from the pair of conveyance rollers 202 to the intermediate stacker 210.

③ After it is detected that the trailing edge of the first page of the sheets P1, conveyed to the intermediate stacker 210, has passed through a sheet trailing edge detection sensor S42, provided near the pair of conveyance rollers 202, the stepping motor M3 starts its stepping of 27 steps in the normal direction (clockwise) after a predetermined time t1 (for example, 100 ms) of a timer has passed. By this operation, the movable alignment plate 241 advances 17 mm and stops at the D3 position. Accordingly, the distance between the movable alignment plate 241 and the side edge of the sheet P is 3 mm at this stop position D3 (refer to FIG. 11(*a*-2), and FIG. 10(*a*)). The above-described predetermined time t1 is the time during which the sheet P1 slides down on the intermediate stacker 210 and delivery belt 211, and arrives at the winding roller 207, after the sheet P1 has been conveyed from the pair of the conveyance rollers 202. The movable alignment plate 241 stops and waits for the next operation for a predetermined time t2 (170 ms) at this stop position D3. During this stopping time, the sheet P1 is guided by the reference surface 210A of the stacker 210, and a movable stopper 241 located at the position D3, which is 3 mm apart from the sheet width W, and slides down on the intermediate stacker 210, and pushes against the stopper member 231.

④ Next, the stepping motor M3 is reversely rotated (by 27 steps) (in the CCW direction), and the movable alignment plate 241 is withdrawn by 17 mm, and returns to the reference position for waiting D1.

⑤ When two sheets are stapled, the stepping motor M3 is driven in the normal direction (in the CW direction) by 24 steps, and the movable alignment plate 241 advances by 15 mm (refer to FIG. 11(*b*-2)), after a predetermined time t1 (100 ms) has passed after the detection of passage of the trailing edge of the sheet P2 by the sensor 42. The movable alignment plate 241 waits for a predetermined time t3 (140 ms) at this advance stop position E1. This predetermined time t3 is set by a timer to a time during which the sheet P slides down on the sheet P1 placed on the intermediate stacker 210 and the trailing edge of the sheet P is brought into contact with the stopper member 231, and the sheet P3, which will be described later, is conveyed from the pair of conveyance rollers 202.

⑥ After a predetermined time t3 has passed, the stepping motor M3 rotates again for 13 steps in the CW direction. The movable alignment plate 241 further advances by 8 mm, and stops at the E2 position. At this E2 position, the sheets P1 and P2 placed on the intermediate stacker 210 are compressed by 3 mm, (15+8–20 mm), in the sheet width direction. The surfaces of sheets P1 and P2 are curved, and the right ends of sheets P1 and P2, (as shown in the drawing), are in pressure-contact with the reference surface 210A of the intermediate stacker 210, and sheets are aligned (refer to FIG. 11(*b*-3) and FIG. 10(*b*)).

⑦ After that, the stepping motor M3 is reversed in the CCW direction for 37 steps. The movable alignment plate 241 is withdrawn for 23 mm, and returns to its initial reference position for waiting D1. Next, the stepping motor M3 is rotated in the CW direction by 37 steps, and the movable alignment plate 241 advances by 23 mm. The sheets P1 and P2 are curved again inside the side edge of the sheet by 3 mm, and last alignment is carried out, at the E2 position.

⑧ Next, staple operations are carried out under these conditions. After staple operations, the movable alignment plate 241 is slightly withdrawn (8 steps, 24 mm), and the stapled sheets P1 and P2 are delivered onto sheet delivery tray T1 by the sheet delivery belt 211. After the completion of the sheet delivery operations, the movable alignment plate 241 returns to its initial reference position for waiting D1.

As described above, in the case where two sheets of P1 and P2 are stapled, the movable alignment plate 241 is located at D3 position, which is 3 mm from the side edge of the sheet, when the first sheet P1 slides down on the intermediate stacker 210. In this case, the first sheet P1 easily slides down on the intermediate stacker 210 and the delivery belt 211 without pressure-contact, resulting in minimum sheet skewing. When the second sheet P2 slides down, sheets P1 and P2 are in pressure-contact with the movable alignment plate 241, and simultaneously sheet alignment is carried out.

⑨ When 3 to 9 sheets are aligned and stapled, the first sheet P1 is aligned in the same manner as described above, as shown in FIG. 15(*b*), and the second sheet P2 is irregularly aligned (362 ms) in such a manner that the rotation of the stepping motor in the CW direction at the time of the last alignment of the second sheet in FIG. 15(*a*), is omitted. Then, the third and successive sheets are aligned in the same manner as the last alignment (573 ms) in the case where two sheets are stapled as described above.

FIGS. 12(*a*) through 12(*e*) are plan views showing the model of alignment processes of sheets P, the number of which is not less than 10. When the number of sheets P, stacked on the intermediate stacker 210, is not less than 10, the movable alignment plate 241 does not arrive to the alignment position E2 (in the CW direction, by 23 mm), which is the alignment position in the case of small number of sheets, due to stiffness of the sheet P, although the case is somewhat different depending on the size, weight and quality of the sheet P. The stepping motor M3 of the drive source is out of step, the movable alignment plate 241 stops at the sheet width position D2 (in the CW direction, by 20 mm), and the sheets are aligned at this alignment position D2 (refer to FIG. 12(*b*)). After the sheets have been aligned, the movable alignment plate 241 returns (in the CCW direction, by 23 mm) to the waiting position F1, and stops. This waiting position F1 is a position which is withdrawn by 3 mm from the initial reference position for waiting D1, because the stepping motor M3 is already out of step (refer to FIG. 12(*c*)). Successive sheets P are continuously aligned by the same strokes from this waiting position F1 (in the CW direction by 23 mm, and in the CCW direction by 23 mm), (refer to FIGS. 12(*d*) and 12(*e*)).

FIGS. 17(*a*-1) and 17(*a*-2) are plan views explaining the model of operation processes of the alignment means 240 after one small volume of sheets has been copied. After one volume of sheets has been copied, the last page of sheet P is aligned and stacked on the intermediate stacker 210. After that, the staple operation is carried out, and then, the movable alignment plate 241 is withdrawn to the position D3 which is apart from the sheet width position D2 by a predetermined small distance (3 mm in the drawing). Under this withdrawal condition of the movable alignment plate 241, the volume of sheets P is delivered and stacked on the sheet delivery tray T1, provided outside of the copier, through the sheet delivery means 280 by the mutual operation of the sheet transfer lever 233 and delivery belt 211. At the time of this sheet volume delivery, the movable alignment plate 241, located at the withdrawal position D3, regulates the inclination of the volume of sheets. When the volume of sheets has passed through the alignment means 240 and delivery belt 211, the movable alignment plate 241 is withdrawn and returns to the reference position for waiting D1.

FIGS. 17(*b*-1) through 17(*b*-3) are plan views explaining the model of operation processes of the alignment means 240 when one volume of a large number of sheets has been copied. After one volume of sheets has been copied, the last page of sheets P is aligned and stacked on the intermediate stacker 210. Then, it is stapled, and the movable alignment plate 241 is withdrawn to the D3 position as described above. After the volume of sheets has been delivered, the movable alignment plate 240 temporarily returns to its home position HP. After that, the movable alignment plate 240 advances to the reference position for waiting D1, and waits for the next operation. As explained in FIGS. 12(*a*) through 12(*e*), when a large number of sheets are aligned, since the stepping motor M3 is out of step, the dislocation of the position is corrected by returning the movable alignment plate to the home position HP.

In this connection, although the sheet finishing apparatus of this example is shown as an example in which the sheet finishing apparatus is connected to a copier, it can, of course, be connected to an image forming apparatus such as a printer, facsimile, etc., or a light printer, or the like.

By the sheet alignment apparatus for the sheet finishing apparatus of the present invention, even when the sheet, delivered from an image forming apparatus at high speed, is deviated in the direction perpendicular to the sheet advancing direction, exact sheet alignment operations are quickly carried out from the first sheet. Accordingly, undesirable sheet alignment or jamming, caused by alignment operations, can be prevented, so that a high speed, high efficiency and stable alignment can be carried out, resulting in higher copy productivity.

What is claimed is:

1. A sheet finishing apparatus for finishing sheets ejected from an image forming apparatus, comprising:

(a) conveyance means for receiving sheets ejected from the image forming apparatus and for conveying the sheets;

(b) a stacker disposed obliquely for receiving and for stacking the sheets conveyed from the conveyance means;

(c) a sheet stopper provided adjacent to a lower end of the stacker, for stopping the sheets in an advancing direction of the sheets;

(d) a movable alignment means provided in at least one side edge position of the sheets for oscillating in a width direction perpendicular to the advancing direction of the sheets to align;

(e) drive means for driving the movable alignment means;

(f) a stapler for stapling the sheets stacked on the stacker and aligned by the alignment means; and (g) controller for controlling the drive means such that the movable alignment means is moved to a first position to receive the sheets, at which the movable alignment means is located outside one edge of the width direction of the sheets by a predetermined distance, when the sheets are conveyed onto the stacker from the conveyance means; the movable alignment means is moved to a second position to align the width direction of a first sheet of a plurality of successive sheets, at which the movable alignment means is located closer to the one edge of the sheets than the first position, when the first sheet advances on the stacker toward the sheet stopper; and the movable alignment means is moved to a third position to push the one edge of the sheets for alignment after a second and later sheets collide with the sheet stopper.

2. The apparatus of claim 1 further comprising:

a rotational belt for stapling the sheets stacked on the stacker and aligned by the movable alignment means; and delivery means provided on the belt for holding and for delivering the sheets stapled.

3. The apparatus of claim 1, wherein the movable alignment means is a movable alignment plate.

4. A sheet finishing apparatus for finishing sheets ejected from an image forming apparatus, comprising:

(a) conveyance means for receiving sheets ejected from the image forming apparatus and for conveying the sheets;

(b) a stacker disposed obliquely for receiving and for stacking the sheets conveyed from the conveyance means;

(c) a stopper provided adjacent to a lower end of the stacker, for stopping the sheets in an advancing direction of the sheets;

(d) a movable alignment means provided in at least one side edge position of the sheets for oscillating in a width direction perpendicular to the advancing direction of the sheets to align;

(e) drive means for driving the movable alignment means;

(f) a stapler for stapling the sheets stacked on the stacker and aligned by the alignment means; and (g) controller for controlling the drive means such that the movable alignment means is moved to an initial position to receive the sheets, at which the movable alignment means is located outside one edge of the width direction of the sheets by a predetermined distance, when the sheets are conveyed onto the stacker from the conveyance means; the movable alignment means is moved to an intermediate position to align the advancing direction of the sheets, at which the movable alignment means is located slightly away from the one edge of the sheets, after a trailing edge of each of the sheets passes through a position adjacent to the conveyance means; and the movable alignment means is moved to a alignment position to push the one edge of the sheets for alignment after the sheets collide with the sheet stopper.

5. The apparatus of claim 4 further comprising:

a rotational belt for stapling the sheets stacked on the stacker and aligned by the movable alignment means; and delivery means provided on the belt for holding and for delivering the sheets stapled.

6. The apparatus of claim 4, wherein the movable alignment means is a movable alignment plate.

* * * * *